US005364722A

United States Patent [19]

Tanikawa et al.

[11] Patent Number: 5,364,722

[45] Date of Patent: Nov. 15, 1994

[54] TONER FOR DEVELOPING ELECTROSTATIC IMAGE AND HEAT-FIXING METHOD COMPRISING A HYDROCARBON WAX

[75] Inventors: Hirohide Tanikawa; Hiroaki Kawakami; Masatsugu Fujiwara, all of Yokohama; Masashi Jinbo, Asaka; Tsutomu Onuma, Kawasaki, all of Japan

[73] Assignee: Canon Kabushiki Kaisha, Tokyo, Japan

[21] Appl. No.: 943,032

[22] Filed: Sep. 10, 1992

[30] Foreign Application Priority Data

| | | | |
|---|---|---|---|
| Sep. 11, 1991 | [JP] | Japan | 3-231646 |
| Mar. 4, 1992 | [JP] | Japan | 4-081467 |
| Apr. 22, 1992 | [JP] | Japan | 4-127984 |

[51] Int. Cl.[5] ..... G03G 9/00

[52] U.S. Cl. ..... 430/110; 430/109; 430/904

[58] Field of Search ..... 430/110, 109, 904

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,917,982 | 4/1990 | Tomono et al. | 430/99 |
| 4,921,771 | 5/1990 | Tomono et al. | 430/110 |
| 4,952,476 | 4/1990 | Sakashita et al. | 430/106.6 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,124,225 | 6/1992 | Shibata | 430/110 |
| 5,135,833 | 4/1992 | Matsunaga et al. | 430/110 |

FOREIGN PATENT DOCUMENTS

| | | |
|---|---|---|
| 0417016 | 3/1991 | European Pat. Off. . |
| 52-3304 | 1/1977 | Japan . |
| 52-3305 | 1/1977 | Japan . |
| 56-16144 | 2/1981 | Japan . |
| 57-52574 | 11/1982 | Japan . |
| 60-123851 | 7/1985 | Japan . |
| 60-217366 | 10/1985 | Japan . |
| 60-252360 | 12/1985 | Japan . |
| 60-252361 | 12/1985 | Japan . |
| 61-94062 | 5/1986 | Japan . |
| 61-138259 | 6/1986 | Japan . |
| 61-273554 | 12/1986 | Japan . |
| 62-14166 | 1/1987 | Japan . |
| 1-109359 | 4/1989 | Japan . |
| 1-185665 | 7/1989 | Japan . |
| 2-79860 | 3/1990 | Japan . |
| 3-50559 | 3/1991 | Japan . |

*Primary Examiner*—Steve Rosasco

*Attorney, Agent, or Firm*—Fitzpatrick, Cella, Harper & Scinto

[57] ABSTRACT

A toner for developing electrostatic images is prepared from a binder resin and a hydrocarbon wax. The toner is provided with improved fixability and anti-offset characteristic by controlling the thermal characteristic of the hydrocarbon wax so as to provide a DSC (differential scanning calorimeter) curve, showing an onset temperature of heat absorption in the range of 50°-110° C. and at least one heat absorption peak P1 in the range of 70°-130° C. giving a peak temperature $T_{P1}$ on temperature increase, and showing a maximum heat evolution peak temperature in the range of $T_{P1} \pm 9°$ C. on temperature decrease. Correspondingly, the toner provides a DSC curve showing a rising temperature of heat absorption of at least 80° C., an onset temperature of heat absorption of at most 105° C. and a heat absorption peak temperature in the range of 100°-120° C., respectively on temperature increase, and showing a heat evolution peak temperature in the range of 62°-75° C. and a heat evolution peak intensity ratio of at least $5 \times 10^{-3}$ on temperature decrease.

78 Claims, 9 Drawing Sheets

TONER FOR DEVELOPING ELECTROSTATIC IMAGE AND HEAT-FIXING METHOD COMPRISING A HYDROCARBON WAX

FIELD OF THE INVENTION AND RELATED ART

The present invention relates to a toner for developing electrostatic images used in image forming methods, such as electrophotography electrostatic recording and magnetic recording, suitable for heat fixation and a heat-fixing method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy. The residual toner on the photosensitive member without being transferred is cleaned by various methods, and then the above steps are repeated.

In recent years, such an electrophotographic image forming apparatus has been used not only as a copying machine for office work but also as a printer as an outputting means for a computer and a copier for personal use.

Accordingly, a smaller size, a smaller weight, a higher speed and a higher reliability are being seriously sought, and a machine tends to be composed of simpler members. As a result, a toner is required to show higher performances, and an excellent machine cannot be satisfactorily operated if improved toner performances are not accomplished.

Regarding the step of fixing a toner image onto a sheet such as paper, various methods and apparatus have been developed, inclusive of those based on the heat-fixing system using hot rollers, and the heat-fixing method of pressing a toner image onto a sheet by a heating member by the medium of a film.

In the heat-fixing system using such hot rollers or a film, a sheet carrying a toner image to be fixed (hereinafter called "fixation sheet") is passed, while the surface of a hot roller or a film having a releasability with the toner is caused to contact the toner image surface of the fixation sheet under pressure, to fix the toner image. In this method, as the hot roller or film surface and the toner image on the fixation sheet contact each other under a pressure, a very good heat efficiency is attained for melt-fixing the toner image onto the fixation sheet to afford quick fixation, so that the method is very effective in a high-speed electrophotographic copying machine. In this method, however, a toner image in a melted state is caused to contact a hot roller or film surface under pressure, so that there is observed a so-called offset phenomenon that a part of the toner image is attached and transferred to the hot roller or film surface and then transferred back to the fixation sheet to stain the fixation sheet. It has been regarded as one of the important conditions in the heat-fixing system to prevent the toner from sticking to the hot roller or film surface.

In order to prevent a toner from sticking onto a fixing roller surface, it has been conventionally practiced to compose the roller surface of a material showing excellent releasability against the toner, (e.g., silicone rubber or fluorine-containing resin) and further coating the surface with a film of a liquid showing a good releasability, such as silicone oil, so as to prevent the offset and fatigue of the roller surface. This method is very effective for preventing offset but requires a device for supplying such an offset preventing liquid, thus resulting in complication of a fixing apparatus.

Further, this is contrary to the demand for a smaller and lighter apparatus and can sometimes soil the inside of the apparatus due to vaporization of the silicone oil, etc. Therefore, based on a concept of supplying an offset-preventing liquid from inside toner particles under heating instead of using a device of supplying silicone oil, there has been proposed to incorporate a release agent, such as low-molecular weight polyethylene or low-molecular weight polypropylene. Addition of such a release agent in an amount exhibiting a sufficient effect leads to other practical problems, such as filming onto a photosensitive member, soiling of the surface of a carrier or a toner-carrying men%her, such as a sleeve, and deterioration of developed images. Accordingly, there has been adopted a combination of adding a release agent in an Mount small enough to avoid deterioration of developed images into toner particles and supplying a small amount of a release oil or using a cleaning device including a web used little by little to be wormed up for removing offset toner.

However, in view of recent demands for a smaller, lighter and more reliable apparatus, it is desired to remove even such an auxiliary device. This cannot be complied with, unless the toner performances, such as fixability and anti-offset characteristic, are further improved. Thus, it is difficult to provide such an excellent toner without further improvement of a binder resin and a release agent in a toner.

The addition of waxes as a release agent in toner particles is known, as disclosed in, e.g., Japanese Laid-Open Patent Application (JP-A) 52-3304, JP-A 52-3305, JP-A 57-52574, JP-A H3-50559, JP-A H2-79860, JP-A H1-109359, JP-A 62-14166, JP-A 61-273554, JP-A 61-94062, JP-A 61-138259, JP-A 60-252361, JP-A 60-252360, and JP-A 60-217366.

Waxes have been used to provide a toner improved in anti-offset characteristic at low or high temperature and fixability at a low temperature. These performances may be improved but the addition of waxes can lead to adverse effects, such as deterioration of anti-blocking property, deterioration of developing performance when exposed to heat on an occasion of an elevation in temperature within a copier, and deterioration in developing performance due to bleeding of the wax during standing for a long term.

Thus, any conventional toner containing a wax cannot fulfill all the required performances at a satisfactory level but has involved some problem. For example, some toner is excellent in high-temperature offset and developing performance but leaves a room for improvement with respect to low-temperature fixability. Some toner is excellent in low-temperature offset and low-temperature fixability but is somewhat inferior in anti-blocking characteristic or results in a lower developing performance at an elevated temperature within an apparatus. Some toner is insufficient in satisfaction of anti-offset characteristic at both low and high temperatures.

A toner containing a low-molecular weight polypropylene (e.g., "Viscol 550P", "Viscol 660P", etc.) is on the market but has left a room for further improvement in anti-offset characteristic and fixability.

Further, JP-A 56-16144 has proposed a toner containing a binder resin which shows at least one maximum in each of the molecular weigh region of $10^3-8\times10^4$ and $10^5-2\times10^6$. The toner is excellent in pulverizability, anti-offset characteristic, fixability, anti-melt sticking or -filming onto a photosensitive member and image forming characteristic, but further improvements in anti-offset characteristic are still desired.

SUMMARY OF THE INVENTION

An object of the present invention is to provide a toner having solved the above problems.

A more specific object of the invention is to provide a toner excellent in fixability and anti-offset characteristic at low temperatures.

Another object of the invention is to provide a toner excellent in fixability and anti-offset characteristic at high temperatures.

Another object of the invention is to provide a toner excellent in anti-blocking characteristic and free from deterioration in developing performance even left standing for a long period.

Another object of the invention is to provide a toner excellent in resistance to a temperature elevation in an apparatus.

A further object of the invention is to provide a heat-fixing method using a toner as described above.

According to the present invention, there is provided a toner for developing electrostatic image, comprising a binder resin and a hydrocarbon wax, wherein the hydrocarbon wax provides a DSC curve, as measured by a differential scanning calorimeter, showing an onset temperature of heat absorption in the range of 50°–110° C. and at least one heat absorption peak P1 in the range of 70°–130° C. giving a peak temperature $T_{P1}$ on temperature increase, and showing a maximum heat evolution peak giving a peak temperature in the range of $T_{P1}\pm9°$ C. on temperature decrease.

According to another aspect, the present invention provides a toner for developing electrostatic images, comprising a binder resin and a hydrocarbon wax; wherein the toner provides a DSC curve as measured by a differential scanning calorimeter, showing a rising temperature of heat absorption of at least 80° C., an onset temperature of heat absorption of at most 105° C. and a heat absorption peak temperature in the range of 100°–120° C., respectively on temperature increase, and showing a heat evolution peak giving a heat evolution peak temperature in the range of 62°–75° C. and a heat evolution peak intensity ratio of at least $5\times10^{-3}$ on temperature decrease.

According to still another aspect, the present invention provides a heat-fixing method, comprising an image of a toner as described above carried by a toner-carrying member onto the toner-carrying member by a contact-heating means.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
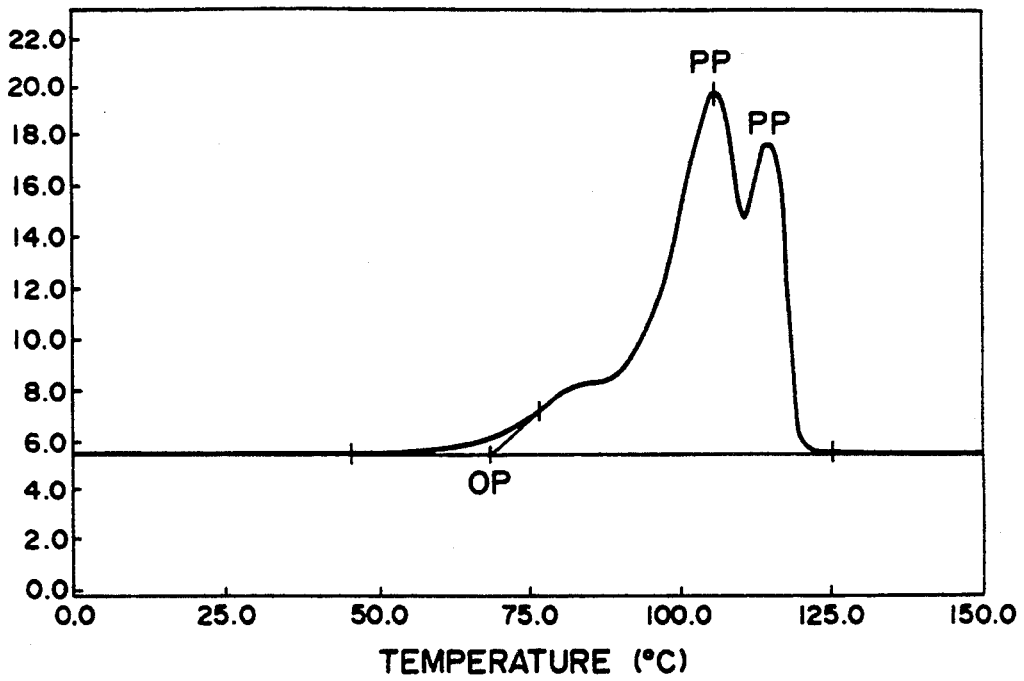
FIGS. 1, 3, 5 and 18 respectively show DSC curves on temperature increase of wax A3 according to the invention (FIG. 1), wax F3 according to a comparative example (FIG. 3), toner 11 according to the invention (FIG. 5) and wax A2 according to the invention (FIG. 18).

By analyzing data obtained by subjecting a toner to differential scanning calorimetry by using a DSC (differential scanning calorimeter), it is possible to know a thermal behavior of a toner. More specifically, from such data, it is possible to know heat transfer to and from a toner and changes in state of the toner. For example, it is possible to know whether or not offset phenomenon can be obviated and what are thermal influences during storage and actual use, inclusive of the anti-blocking characteristic and the effect of heating on the developing performance of the toner.

From a DSC curve on temperature increase, it is possible to observe a state change of a toner under heat application and heat absorption peaks accompanying the transfer, melting or dissolution of the wax component.

The toner according to the present invention is characterized by having an onset temperature (OP) of at most 105° C., preferably in the range of 90°–102° C., whereby the toner is provided with excellent low-temperature fixability. On the other hand, if the onset temperature exceeds 105° C., the toner is caused to have a higher temperature for plasticity change in a short time range, thus being inferior in anti-offset characteristic at low temperatures and fixability.

Further, the toner is characterized by having a heat absorption peak temperature in the range of 100°–120° C., preferably 102°–115° C., whereby good fixability and anti-offset characteristic at high temperatures is ensured. If the heat absorption peak temperature is below 100° C., the wax component dissolves in the binder resin before the temperature becomes high, so that it becomes difficult to obtain sufficient anti-offset characteristic of high temperatures. On the other hand, if the heat absorption peak temperature exceeds 120° C., it is difficult to obtain sufficient fixability.

A toner binder resin used for heat-fixing enters a viscoelastic region susceptible of fixation from about 100° C. and, if the wax component is melted in the temperature region, the resin is provided with an increased plasticity and an improved fixability, and the release effect is sufficiently exhibited to provide an improved anti-offset characteristic. As a result, paper carrying the toner image after fixation does not adhere to the fixing roller or film, thus unnecessitating reliance on a separation claw to be free from traces of the claw. Also the pressing roller is not stained and winding about the pressing roller is obviated. Provided that the above conditions are satisfied, another peak can be present in another region.

It is further preferred that the toner has an heat absorption peak showing a rising (initiation) temperature (LP) of at least 80° C., further preferably at least 90° C., so as to provide a better anti-blocking characteristic. Below 80° C., the toner is liable to start causing a plasticity change in a long time range from a relatively low temperature, thus showing inferior storability and inferior developing performance at higher temperatures.

From DSC curves on temperature decrease, it is possible to observe the state at normal temperature and state changes under cooling of a toner, and heat evolution peaks accompanying the solidification or crystallization and other phase transition of the wax component. The toner according to the invention is characterized by having a heat evolution peak temperature in the range of 62°–75° C., preferably 65°–72° C., whereby good fixability and anti-blocking characteristic are ensured. Above 75° C., the temperature range for keeping the wax in a molten state becomes narrow to show inferior fixability. Below 62° C., the toner is liable to cause blocking or sticking, and the plasticity of the binder resin is retained down to a low temperature. As a result, the fixed image can be accompanied with traces of claw at the paper discharging part and sheets carrying toner images can be attached to each other on the discharge tray.

The toner is further characterized by having a peak intensity ratio of at least $5\times10^{-3}$, preferably at least $10\times10^{-3}$, further preferably at least $12\times10^{-3}$, particularly preferably at least $15\times10^{-3}$. A higher peak intensity ratio is related with a wax component having a higher density, a higher crystallinity or a higher hardness, and a toner having less blocking characteristic and excellent triboelectric chargeability. Below $5\times10^{-3}$, the toner is caused to have inferior anti-blocking characteristic and is adversely affected in developing performance, particularly at an elevated temperature. This is particularly pronounced when the peak temperature is lowered. Further, the toner is liable to cause sticking onto the photosensitive member.

The DSC measurement for characterizing the present invention is used to evaluate heat transfer to and from a toner and observe the behavior, and therefore should be performed by using an internal heating input compensation-type differential scanning calorimeter which shows a high accuracy based on the measurement principle. A commercially available example thereof is "DSC-7" (trade name) mfd. by Perkin-Elmer Corp. In this case, it is appropriate to use a sample weight of about 10–15 mg for a toner sample or about 2–5 mg for a wax sample.

The measurement may be performed according to ASTM D3418-82. Before a DSC curve is taken, a sample (toner or wax) is once heated for removing its thermal history and then subjected to cooling (temperature decrease) and heating (temperature increase) respectively at a rate of 10° C./min. in a temperature range of 0° C. to 200° C. for taking DSC curves. The temperatures or parameters characterizing the invention are defined as follows.

1) Regarding a heat absorption peak of a toner (absorbed heat is taken in the positive (or upward) direction):

The rising temperature (LP) is defined as a temperature at which the peak curve clearly separates from the base line, i.e., a temperature at which the differential of a peak curve begins to increase from a steady positive value or a temperature at which the differential of a peak curve turns from a negative to a positive. Specific examples are shown in FIGS. 5 and 7–10.

The onset temperature (OP) is a temperature at which a tangential line take at a point giving the largest differential on a peak curve intersects the base line. Specific examples thereof are also shown in FIGS. 5 and 7–10.

The peak temperature (PP) is a temperature at which a maximum peak in the region of 120° C. or below assumes a peak top.

2) Regarding a heat evolution peak of a toner (evolved heat is taken in the negative (or downward) direction):

The peak temperature is a temperature at which a maximum peak assumes a peak top.

The peak intensity ratio is defined by $\Delta H/\Delta T$. For this purpose, two tangential lines are taken at points giving maximum and minimum differentials on the above peak to provide two intersections with the base line. The temperature difference between the two intersections is denoted by $\Delta T$. On the other hand, $\Delta H$ denotes a height of the peak top from the base line per unit weight of the sample in terms of mW/mg and is obtained by dividing a measured peak height on a DSC curve by a sample weight. Specific examples thereof are shown in FIGS. 6 and 11–14. Accordingly, a higher peak intensity ratio corresponds to a sharper peak if an almost identical weight of sample is used.

Wax parameters may be defined similarly and some definitions are supplemented as follows.

Figure 3:
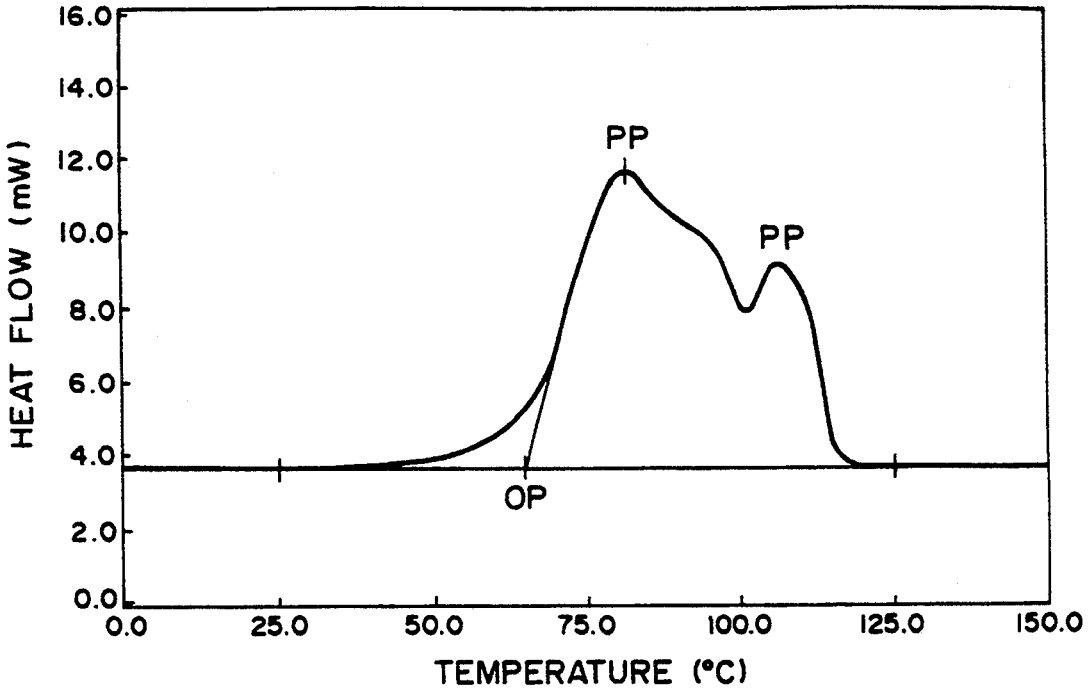
Figure 5:
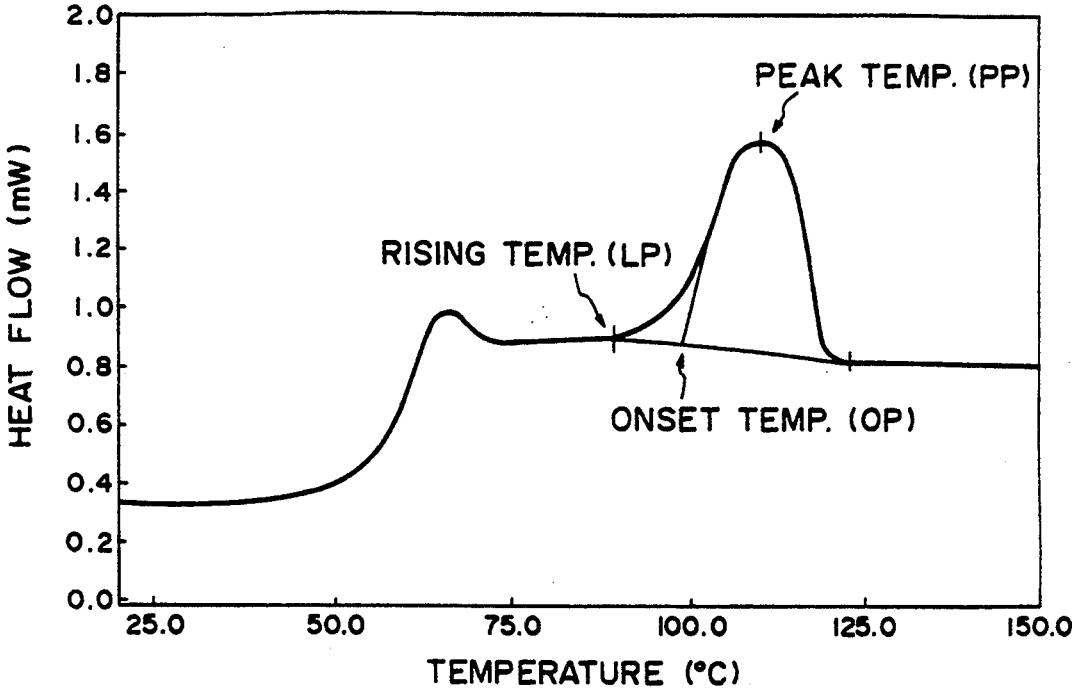

3) Regarding a heat absorption peak of wax (absorbed heat is taken in the positive direction):

Specific examples are shown in FIGS. 1, 3 and 5.

Peak temperature of heat absorption peak (PP) refers to a temperature at which any peak assumes a peak top in the temperature region of 70°–130° C. on temperature increase.

Figure 15:
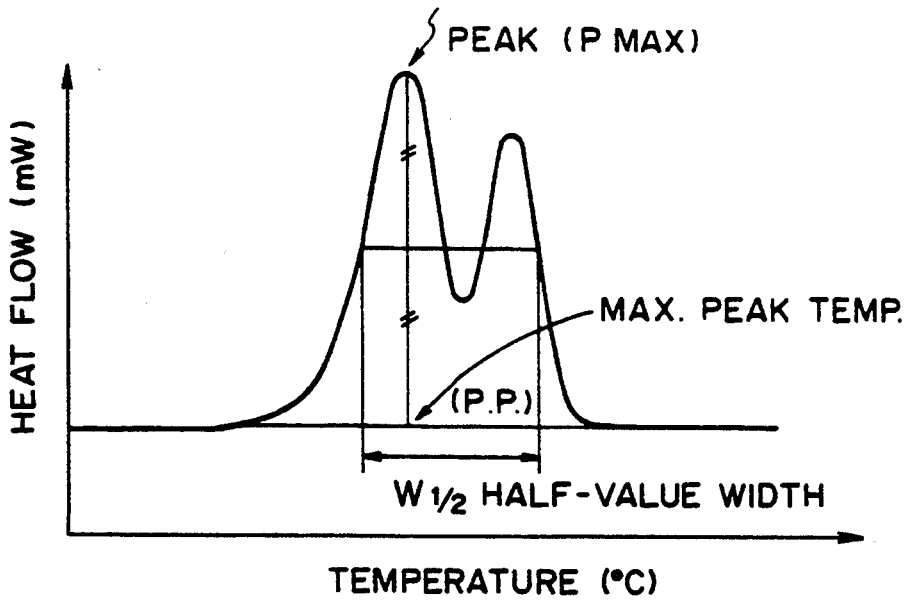
Figure 16:
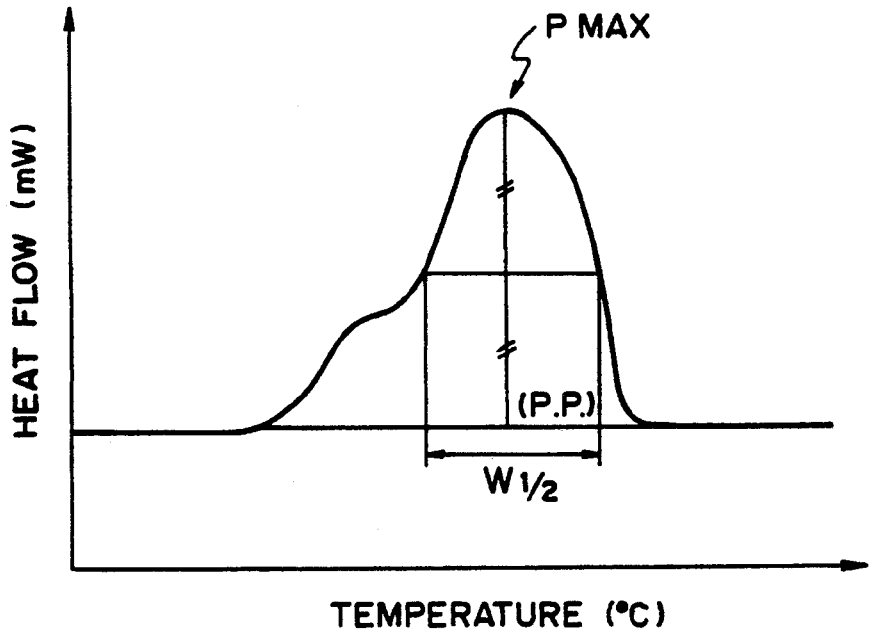
Figure 17:
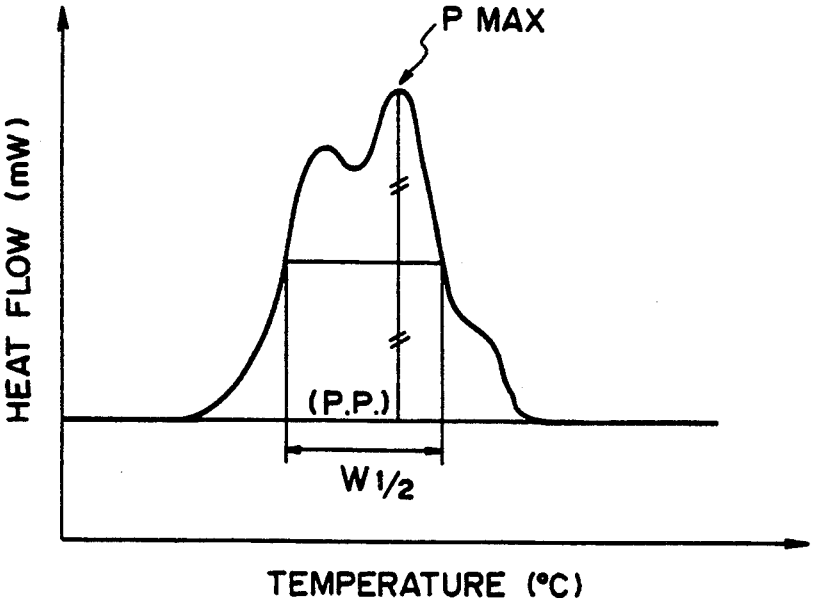
Figure 18:
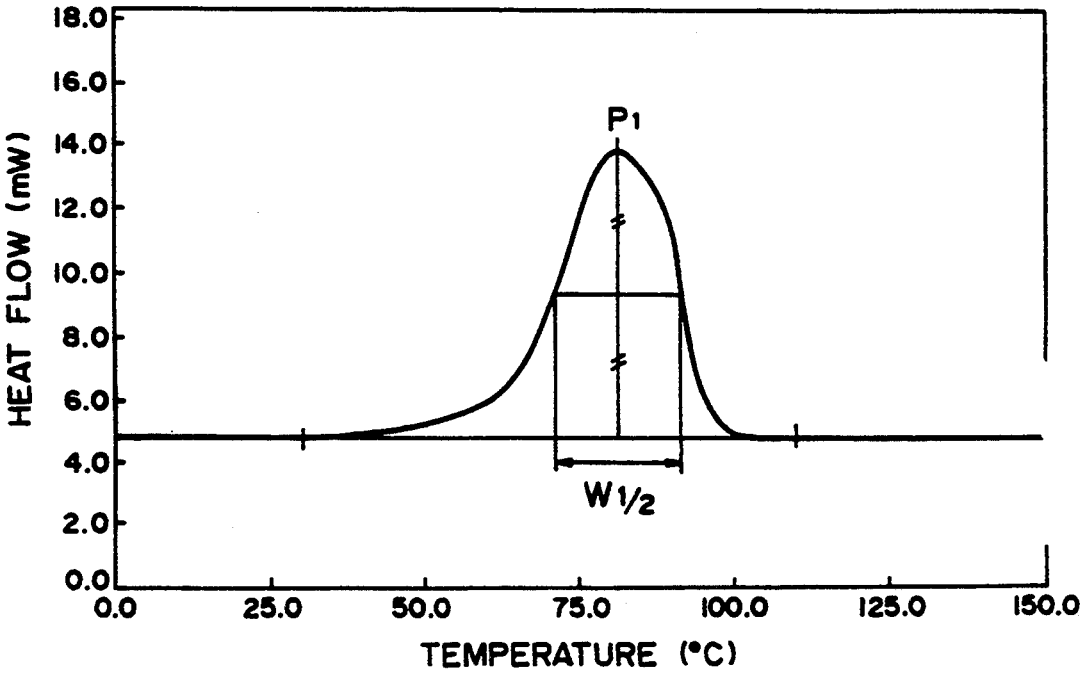
Figure 19:
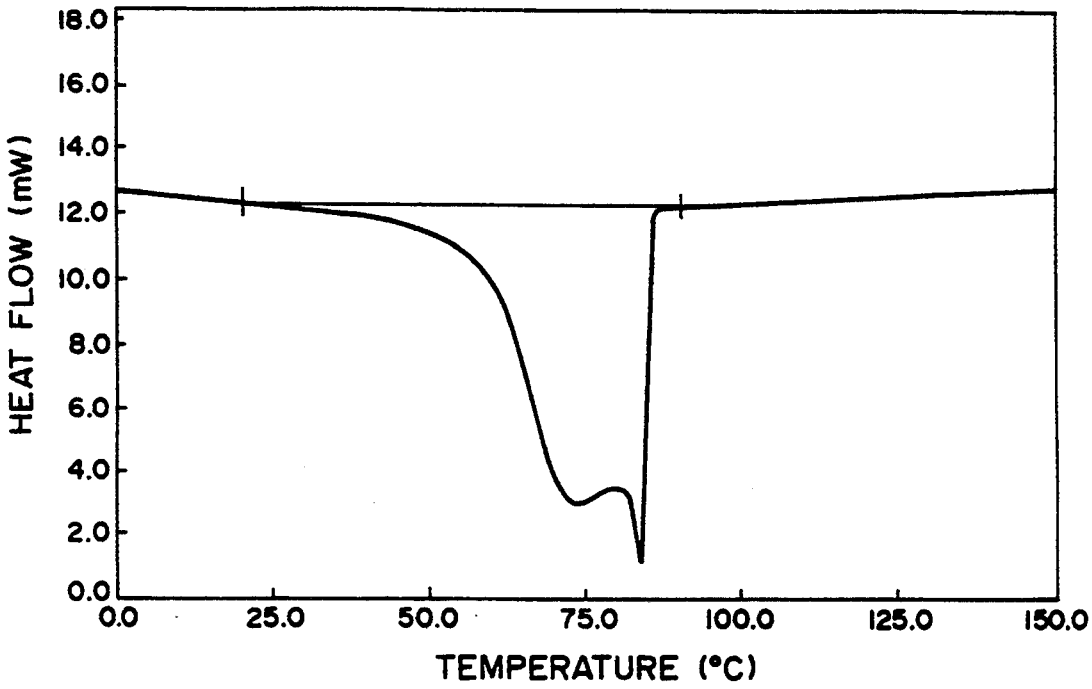

Half-value width $W_{\frac{1}{2}}$ of a maximum heat absorption peak refers to a temperature difference over which a heat absorption peak spans at a half height of a maximum heat absorption peak. If the peak giving $W_{\frac{1}{2}}$ is continuously present above the base line, the peak need not have a height exceeding the half height all over the half-value width $W_{\frac{1}{2}}$. Specific examples for taking $W_{\frac{1}{2}}$ are shown in FIGS. 15–17.

Onset temperature (OP) refers to a temperature at which a tangential line taken at a point first giving a maximum differential on a peak curve intersects the base line. This is somewhat different from the definition of the onset temperature of a toner.

Figure 2:
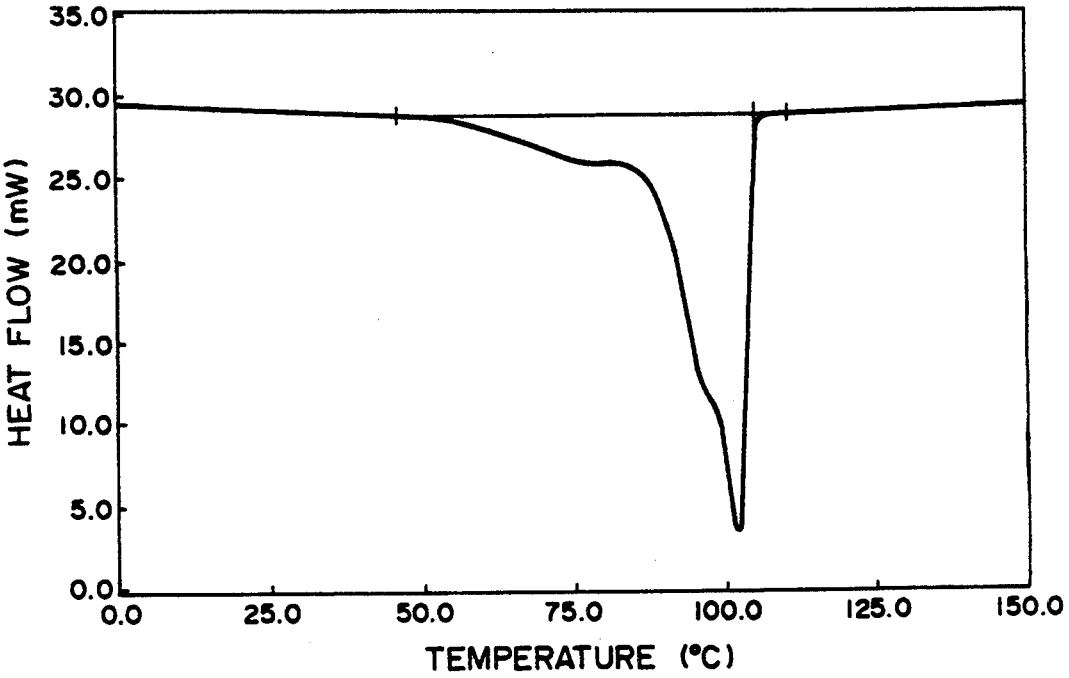
FIGS. 2, 4, 6 and 19 respectively show DSC curves on temperature decrease of wax A3 according to the invention (FIG. 2), wax F3 according to a comparative example (FIG. 4), toner 11 according to the invention (FIG. 6), and wax A2 according to the invention (FIG. 19).
Figure 4:
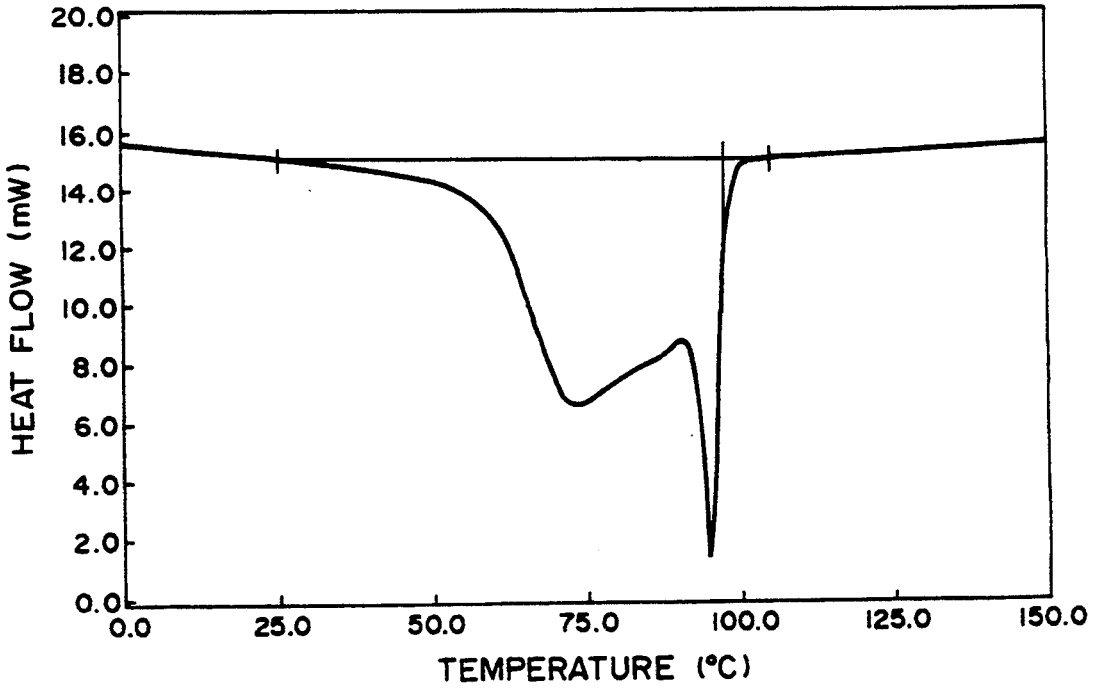
Figure 6:
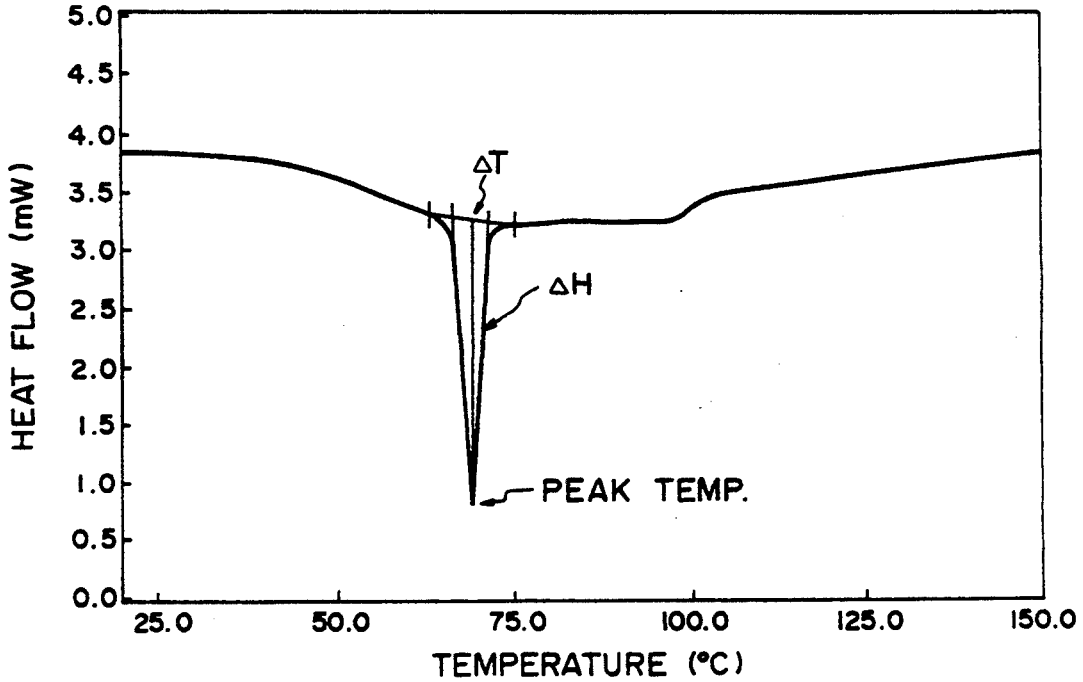
Figure 7:
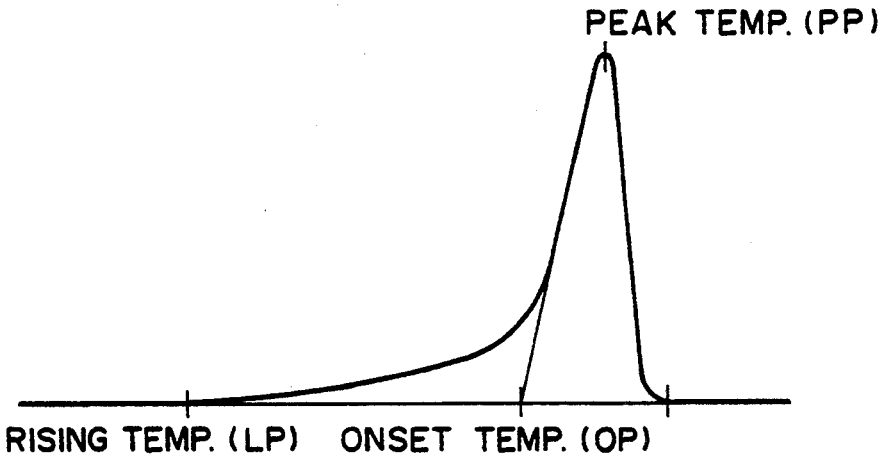
FIGS. 7–10 and 15–17 each show a heat absorption peak portion of a DSC curve on temperature increase.
Figure 8:
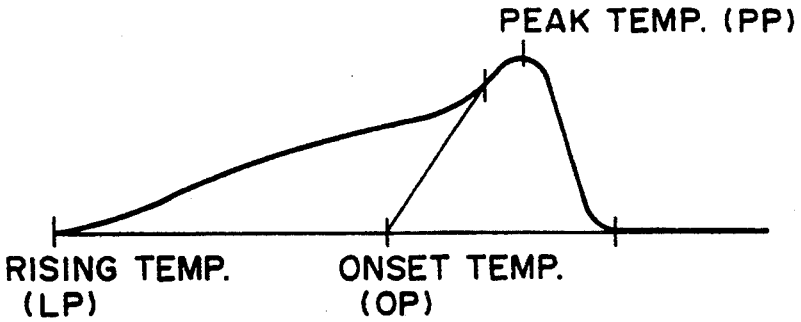
Figure 9:
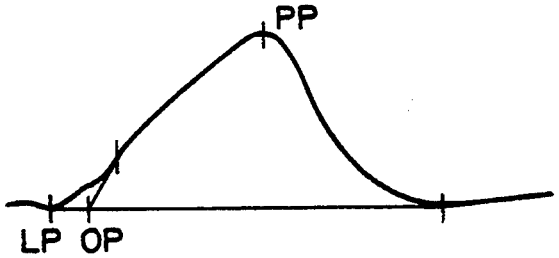
Figure 10:
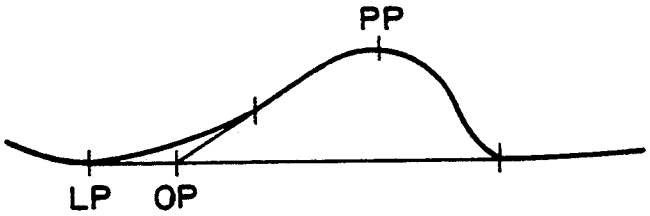
Figure 11:
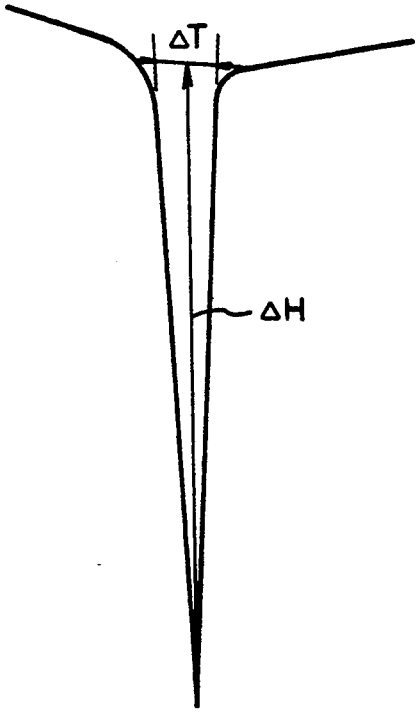
FIGS. 11–14 each show a heat evolution peak portion of a DSC curve on temperature decrease for illustration of a heat evolution peak intensity ratio.
Figure 12:
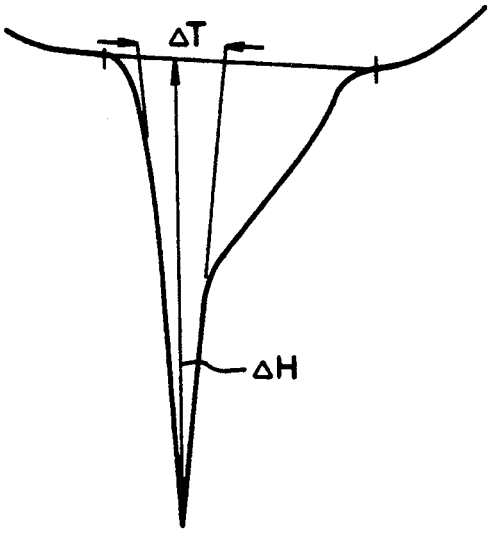
Figure 13:
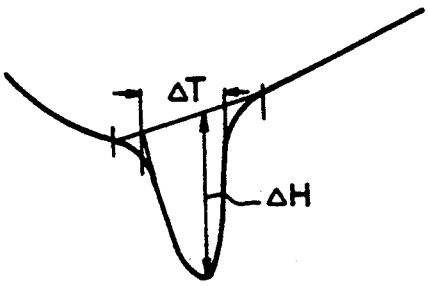
Figure 14:
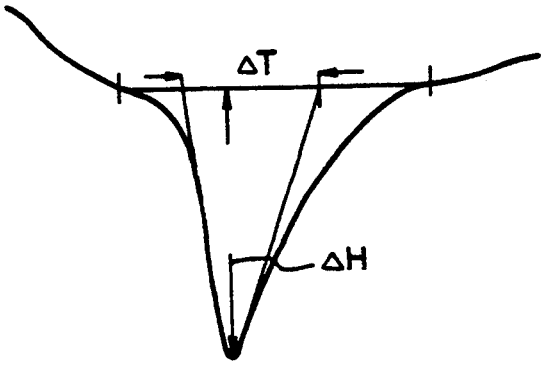

4) Regarding a heat evolution peak (evolved heat is taken in the negative direction):

Specific examples are shown in FIGS. 2, 4 and 6.

Peak temperature refers to a temperature at which a maximum peak on temperature decrease assumes a peak top.

The hydrocarbon wax used in the present invention may comprise, e.g.: a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a hydrocarbon mixture, distilling the hydrocarbon mixture to recover a residue and extracting a specific fraction from the residue. Fractionation of wax may be performed by the press sweating method, the solvent method, vacuum distillation or fractionating crystallization. According to appropriate combination of these fractionation methods for removal of a low-molecular weight fraction, etc. a desired faction of wax is recovered.

As the source of the hydrocarbon wax, it is preferred to use hydrocarbons having up to several hundred carbon atoms (followed by hydrogenation to obtain an objective product) as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few and small branches. It is further preferred to use hydrocarbon waxes synthesized without polymerization because of their structure and molecular weight distribution suitable for easy fractionation. As for a desired molecular weight distribution, the hydrocarbon wax may preferably have a number-average molecular weight (Mn) of 550–1200, particularly 600–1000; a weight-average molecular weight (Mw) of 800–3600, particularly 900–3000; and an Mw/Mn ratio of at most 3, further preferably at most 2.5, particularly preferably at most 2.0. It is also preferred that the wax shows a peak in a molecular weight region of 700–2400, further 750–2000, particularly 800–1600. By satisfying such molecular weight distribution, the resultant toner is provided with preferable thermal characteristics. If the molecular weights are smaller than the above-described ranges, the toner is excessively affected thermally and is liable to be inferior in anti-blocking characteristic and developing performance. In excess of the above molecular weight ranges, an externally supplied heat is not utilized effectively so that it becomes difficult to attain excellent fixability and anti-offset characteristic.

As for other properties, the hydrocarbon wax may have a density at 25° C. of at least 0.93 g/cm$^3$, preferably at least 0.95 g/cm$^3$, and a penetration of at most $5\times10^{-1}$ mm, preferably at most $3\times10^{-1}$ mm, more preferably at most $1.5\times10^{-1}$ mm, particularly preferably at most $1.0\times10^{-1}$ mm. Outside these ranges, the properties are changed excessively at low temperatures to provide inferior storability and developing performance. The wax may desirably have a crystallinity of at least 80%, preferably at least 85%, in view of its uniformity, so that it does not adversely affect the triboelectric chargeability and is dispersed in a state of easy phase separation suited for exhibiting a release effect to provide excellent anti-offset characteristic.

Further, the wax may have a melt viscosity at 140° C. of at most 100 cp, preferably at most 50 cp, particularly preferably at most 20 cp. If the melt viscosity exceeds 100 cp, the plasticizing effect and release effect are inferior to adversely affect the fixability and anti-offset characteristic. The wax may preferably have a softening point of at most 130° C., particularly at most 120° C. In excess of 130° C., the temperature for exhibiting a particularly effective release effect becomes high and the anti-offset characteristic is adversely affected.

Further, the wax may have an acid value of below 2.0 mgKOH/g, preferably below 1.0 mgKOH/g. In excess of the range, the wax is caused to have a large interfacial adhesion with the binder resin as another component of the toner to be liable to cause insufficient phase separation under melting, thus being liable to fail in showing good release effect and anti-offset characteristic at high temperatures, and also liable to adversely affect the triboelectric chargeability, developing performance and durability of the resultant toner.

The hydrocarbon wax may be contained in an amount of at most 20 wt. parts, more effectively 0.5–10 wt. parts, per 100 wt. parts of the binder resin.

The molecular weight distribution of hydrocarbon wax may be obtained based on measurement by GPC (gel permeation chromatography), e.g., under the following conditions:

Apparatus: "GPC-150C" (available from Waters Co.)
Column: "GMH-HT" 30 cm-binary (available from Toso K.K.)
Temperature: 135° C.
Solvent: o-dichlorobenzene containing 0.1% of ionol.
Flow rate: 1.0 ml/min.
Sample: 0.4 ml of a 0.15%-sample.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Honwink viscosity formula.

The density and softening point referred to herein are based on measurement according to JIS K6760 and JIS K2207, respectively.

The penetrations of waxes referred to herein are based on measurement according JIS K-2207 whereby a styrus having a conical tip with a diameter of about 1 mm and an apex angle of 9 degrees is caused to penetrate into a sample for 5 sec. under a prescribed weight of 100 g at a sample temperature of 25° C. The measured value is expressed in the unit of 0.1 mm.

The melt viscosity is based on measurement by using a Brookfield-type viscometer by using 10 ml of a sample at a temperature of 140° C. and a shear rate of 1.32 rpm.

The acid value refers to an amount (mg) of potassium hydroxide required for neutralizing the acid group contained in 1 g of a sample and is based on measurement according to JIS K5902.

The crystallinity is based on measurement by X-ray diffraction. A crystal provides a very sharp peak and an amorphous material provides a very broad peak, respectively, in the X-ray diffraction pattern. In case of a sample comprising a crystalline part and an amorphous part, the crystallinity refers to the proportion of the crystalline part of the sample. The total scattering intensity of X rays (intensity of interferential scattering except for the Compton scattering) is always constant regardless of the weight ratio between the crystalline and amorphous parts. Accordingly, the crystallinity x (%) is calculated by the following equation:

$$x\ (\%)=[Ic/(Ic+Ia)]\times 100,$$

wherein Ic denotes a scattering intensity peak area attributable to the crystalline part of a sample and Ia denotes a scattering intensity peak area attributable to the amorphous part of the sample.

A preferred embodiment of the toner according to the present invention is characterized by comprising a binder resin, and a hydrocarbon wax which provides a DSC curve as measured by a differential scanning calorimeter, including at least one heat absorption peak P1 giving a peak temperature $T_{P1}$ in the range of 70°–130° C., preferably 90°–120° C., on temperature increase and a maximum heat evolution peak giving a peak temperature in the range of $T_{P1}\pm 9°$ C. on temperature decrease.

From a DSC curve of a wax on temperature increase, it is possible to observe a state change of the wax under heat application and heat absorption peaks accompanying the melting or another phase transition of the wax.

If a heat absorption peak is present in the temperature region of 70°–130° C., preferably 90°–120° C., further preferably 95°–120° C., particularly preferably 97°–115° C., good fixability and anti-offset characteristic are satisfied with respect to the resultant toner. If there is a peak temperature only in the region of below 70° C., the wax has too low a melting temperature, thus failing to provide a sufficient anti-offset characteristic at high temperatures. If there is a peak temperature only in the region of above 130° C., the wax has too high a melting temperature, thus failing to provide sufficient anti-offset characteristic and fixability at low temperatures. In other words, if there is a peak temperature in the above-mentioned range, it becomes easy to satisfy a balance of anti-offset characteristic and fixability. In case where a maximum peak is present in the temperature region of below 70° C., a similar behavior is attained as in the case where there is a peak temperature in the temperature region. Accordingly, a peak can be present in the temperature region but, in that case, the peak should be smaller than a peak in the temperature region of 70°–130° C.

Further, the wax may preferably have an onset temperature of a heat absorption peak in the range of 50°–110° C., further preferably 50°–90° C., particularly preferably 60°–90° C., whereby satisfactory developing performance, anti-blocking characteristic and low-temperature fixability are ensured. If the peak onset temperature is below 50° C., the wax property-changing temperature is too low, thus resulting in a toner which is inferior in anti-blocking characteristic and developing performance at an elevated temperature. If the onset temperature is above 110° C., the wax property-changing temperature is too high, thus failing to provide a sufficient fixability.

From a DSC curve of a wax on temperature decrease, it is possible to observe a state change under cooling or a state at normal temperature of the wax, and heat evolution peaks accompanying the solidification, crystallization or transition of the wax. A maximum heat evolution peak in the course of temperature decrease is a heat evolution peak accompanying the solidification or crystallization of the wax. If the heat evolution peak is present close to a heat absorption peak accompanying the melting of the wax on temperature increase, this means that the wax is rather uniform in respect of its structure and molecular weight distribution. The temperature difference may desirably be at most 9° C., preferably at most 7° C., particularly preferably at most 5° C. By minimizing the temperature difference, the wax is provided with sharp-melting characteristics, inclusive of hardness at low temperatures, quick meltability and a large decrease in melt viscosity on melting, thus providing a good balance among developing performance, anti-blocking characteristic, fixability and anti-offset characteristic. It is preferred that the maximum heat evolution peak is present in the temperature region of 85°–115° C., particularly 90°–110° C.

The hydrocarbon wax may be used in an amount of at most 20 wt. parts, more effectively 0.5–10 wt. parts, per 100 wt. parts of the binder resin, and can be used together with another wax component unless it adversely affects the present invention.

The binder resin for the toner of the present invention may for example be composed of: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polvinyl acetate, silicone resin, polyester resin, polyurethane, polyamide resin, furan resin, epoxy resin, xylene resin, polyvinyl butyral, terpene resin, chmarone-indene resin and petroleum resin.

Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

Another preferred embodiment of the toner according to the present invention is characterized by showing a molecular weight distribution on a GPC chromatogram providing at least one peak in a molecular weight region of $3\times10^3-5\times10^4$ and at least one peak in a molecular weight region of at least $10^5$ and including at least 50% of a component having a molecular weight of at most $10^5$; and containing a hydrocarbon wax which provides a DSC curve including at least one heat absorption peak P1 showing a peak temperature $T_{P1}$ in the range of 70°-130° C. on temperature increase, and a maximum heat evolution peak giving a peak temperature in the range of $T_{P1}\pm9°$ C.

Herein, the molecular weight distribution of a toner is based on measurement by GPC (gel permeation chromatography) of the THF (tetrahydrofuran)-soluble content (mostly composed of the binder resin) of a toner, and the percentage value refers to 0% by weight of a component concerned with respect to the THF-soluble content based on the integrated area on a GPC chromatogram.

A resin component having a molecular weight of at most $5\times10^4$ is a component principally controlling the fixability and blocking characteristic, and a resin component having a molecular weight of at least $10^5$ principally controls the offset characteristic at a high temperature. By appropriately blending these components, it is possible to provide a good balance of fixability and anti-offset characteristic. By incorporating a specific wax component, the toner is provided with effectively improved performance.

As described, the toner is characterized by showing a molecular weight distribution on its GPC chromatogram providing at least one peak in the molecular weight region of $3\times10^3-5\times10^4$, preferably $3\times10^3-3\times10^4$, particularly preferably $5\times10^3-2\times10^4$. It is preferred that the peak in this region is the largest peak so as to provide a good fixability. Below $3\times10^3$, good anti-blocking characteristic cannot be attained. Above $5\times10^4$, good fixability cannot be attained.

It is preferred that at least one peak is present in the molecular weight region of at least $10^5$, preferably $3\times10^5-5\times10^6$, and it is particularly preferred that the largest peak in the molecular weight region of at least $10^5$ is present in the limited molecular weight region of $3\times10^5-2\times10^6$ so as to provide a good anti-offset characteristic at high temperatures. A larger peak molecular weight in this region leads to a better anti-offset at high temperatures and may be suitably used when used in combination with hot rollers capable of applying a pressure but can adversely affect the fixability because of a large elasticity when used in combination with hot rollers not applying a pressure. Accordingly, when used in combination with hot rollers applying a relatively low pressure, it is most preferred that the largest peak in the molecular weight region of at least $10^5$ is present in the region of $3\times10^5-2\times10^6$ and constitutes the second largest peak in the entire molecular weight range so as to provide a good balance of the anti-offset characteristic and the fixability. Another characteristic is that the component in the molecular weight region of $10^5$ or below occupies at least 50%, preferably 60-90%, particularly preferably 65-85%. By satisfying this condition, a good fixability is exhibited and the effect of the wax component is sufficiently exhibited, thus providing a good balance of fixability and anti-offset characteristic. Below 50%, sufficient fixability is not attained and also the pulverizability becomes inferior. Above 90%, offset is liable to be caused at high temperatures.

It is also preferred that the wax component provides a DSC curve as measured by a differential scanning calorimeter, including at least one heat absorption peak P1 in the temperature region of 70°-130° C., further preferably 80°-130° C., particularly preferably 90°-120° C., so as to provide good fixability and anti-offset characteristic. As the wax melts in the temperature region to plasticize the binder resin, thus giving good fixability and showing release effect to provide improved anti-offset characteristic at low and high temperatures. The wax shows an effective plasticizing effect with respect to the component having a molecular weight of at most $10^5$, particularly at most $5\times10^4$, and provides a good fixability when a GPC peak is present in the molecular weight region of $3\times10^3-5\times10^4$ and the component having a molecular weight of at most $10^5$ occupies at least 50 wt. %. However, with respect to a component having a molecular weight of below $3\times10^3$, too large a plasticizing effect is exhibited, thus resulting in an inferior anti-blocking characteristic, so that it is preferred that a GPC peak of the binder resin is present in the above molecular weight region. If the wax peak temperature is below 70° C., a plasticizing effect is exhibited from a low-temperature to provide an inferior anti-blocking characteristic and to be liable to fail in exhibiting a release effect at high temperatures because the wax melts at a relatively low temperature. In the case of the wax peak temperature being below 90° C., an inferior anti-blocking characteristic is liable to result but, if a resin component having a molecular weight of $10^5$ or higher is present, the component suppresses the plasticity of the low molecular weight portion to compensate for the anti-locking characteristic. Further, an inferior anti-offset characteristic is liable to result at high temperatures but some latitude is given with respect to the high-temperature offset characteristic because of the elasticity of the high molecular weight component. On the other hand, a DSC peak can be present in the temperature above 130° C. but, in this case, the wax melting temperature is excessively high to result in inferior fixability and anti-offset characteristic at low temperatures if no DSC peak is present in the region of at most 130° C.

On a DSC curve on temperature decrease, heat evolution peaks accompanying solidification or crystallization of the wax are observed. If the heat evolution peak is present close to a heat absorption peak on temperature increase, this means that the wax is uniform. The temperature difference may preferably be at most 9° C., particularly at most 7° C. By minimizing the temperature difference, the wax becomes sharply melting, causes clear phase separation at high temperatures to show effective release effect, and provides an excellent anti-offset characteristic. Further, as the toner is dispersed in a uniform state in the toner particles, the triboelectric chargeability is not adversely affected, thus providing excellent developing performance. Although the dispersion in the binder resin becomes somewhat difficult, because the phase separation is readily caused, but the presence of a resin component having a molecular weight of at least $10^5$ increases the melt viscosity to improve the dispersibility in the binder resin.

The wax component may preferably provide a DSC curve including a maximum heat absorption peak having a half-value width of at least 10° C., particularly at least 15° C., whereby good low-temperature fixability and anti-offset characteristic at low and high temperatures. If the rising temperature is of a heat absorption peak is low, the wax property-changing temperature becomes low so that it is possible to lower the temperature for plasticizing the binder resin. Accordingly, it is possible to improve the fixability and anti-offset characteristic at low temperatures. If the ending temperature of a heat absorption peak is high, the temperature for completing wax melting becomes high so that the anti-offset characteristic at high temperatures can be improved. Further, a higher heat absorption peak provides a larger change in wax at the temperature. Accordingly, if the maximum heat absorption peak has a larger half-value width, the wax operates effectively for a wider temperature range to provide a wider anti-offset region and improved low-temperature fixability. In case where the half-value width is below 10° C., a high-temperature anti-offset characteristic is exhibited but inferior fixability results if the peak temperature is high and, if the peak temperature is low, a low-temperature anti-offset characteristic is attained but inferior high-temperature anti-offset characteristic results, so that it becomes difficult to take a balance between low-temperature and high-temperature performances. In determining a half-value width, if a peak or peaks are continuously present (i.e., a height at a minimum between peaks is at least $\frac{1}{4}$ of the maximum (i.e., the largest) peak height as a measure), a part of the curve constituting the continuous peaks can assume a height below $\frac{1}{2}$ of the maximum peak height (as shown in FIG. 15) but the object of the present invention is more effectively accomplished when the peak(s) continues over a range of at least 10° C., preferably at least 15° C., at a height of at least $\frac{1}{2}$ of the maximum peak height to provide a required half-value (as shown in FIGS. 16 and 17).

Another preferred embodiment of the toner according to the present invention is characterized by showing a molecular weight-distribution on a GPC chromatogram providing at least one peak (P1) in a molecular weight region of $3\times10^3-5\times10^4$ and at least one peak (P2) in a molecular weight region of at least $10^5$ and including at least 50% of a component having a molecular weight of at most $10^5$; and providing a DSC curve including a heat absorption peak showing an onset temperature of at most 105° C. and a peak temperature in the range of 100°–120° C., and a heat evolution peak showing a peak temperature in the range of 62°–75° C. and a heat evolution peak intensity ratio of at least $5\times10^{-3}$ on temperature decrease.

It is further preferred that the toner shows a molecular weight distribution by GPC providing at least one peak (P1) in a molecular weight region of $3\times10^3-5\times10^4$ and at least one peak (P2) in a molecular weight region of at least $10^5$ such that a maximum peak height (H1) in the lower molecular weight region (of $3\times10^3-5\times10^4$), a maximum peak height (H3) in the higher molecular weight region (of at least $10^5$), and a minimum height (H2) between the peaks satisfy the relations of: H1:H2:H3=3-25:1:1.5-12 and H1>H3.

It is further preferred that the heights H1, H2 and H3 satisfy the relation of H1:H2:H3=5-20:1:2-10, more preferably H1:H2:H3=8-18:1:2-6, so as to provide good fixability and anti-offset characteristic.

Figure 20:
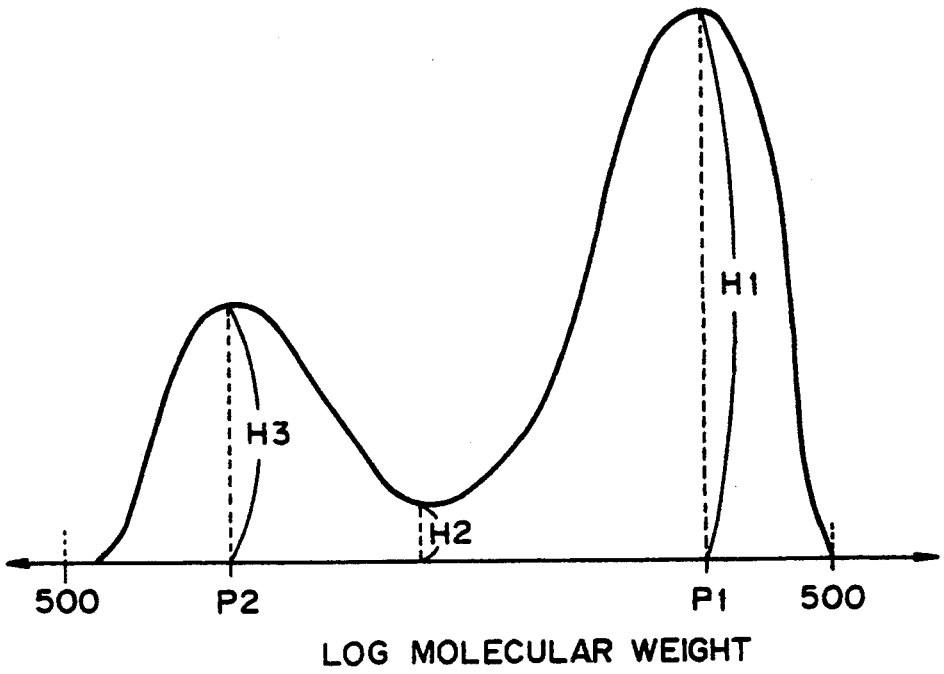
FIG. 20 shows a GPC chromatogram showing a molecular weight distribution for illustration of H1, H2 and H3.

In case where H1 is below 3, H3 is above 12 or H1≦H3, good fixability is not attained. In case where H1 is above 25 or H3 is below 1.5, good anti-blocking characteristic axed anti-offset characteristic are not satisfied (see FIG. 20).

The binder resin satisfying the above-mentioned molecular weight distribution may for example be prepared in the following manner.

A polymer (L) having a main peak in the molecular weight region of $3\times10^3-5\times10^4$ and a polymer (H) having a main peak in the molecular weight region of $10^5$ or containing a gel component, are prepared by solution polymerization, bulk polymerization, suspension polymerization, emulsion polymerization, block copolymerization, graft polymerization, etc. These polymers (L) and (H) are subjected to melt kneading, wherein a part or all of the gel component is served to provide a THF-soluble compound in the molecular weight region of at least $10^5$ measurable by GPC.

Particularly preferred methods may be as follows. The polymers (L) and (H) are separately prepared by solution polymerization and one is added to the solution of the other after the polymerization. One of the polymers is prepared by polymerization in the pressure of the other. The polymer (H) is prepared by suspension polymerization, and the polymer (L) is formed by solution polymerization in the presence of the polymer (H). After the polymerization of the polymer (L) in solution polymerization and, into the solution, the polymer (H) is added. The polisher (H) is formed by suspension polymerization in the presence of the polymer (L). By these methods, it is possible to obtain a polymer mixture including the low-molecular weight component and the high molecular weight component uniformly mixed with each other.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polisher or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization.

The reaction temperature may depend on the solvent and initiator used and the polymer or copolymer to be produced but may suitably be in the range of 70°–230° C. In the solution polymerization, it is preferred to use 30–400 wt. parts of a monomer (mixture) per 100 wt. parts of the solvent. It is also preferred to mix one or more other polymers in the solution after completion of the polymerization.

In order to produce a high-molecular weight polymer component or a gel component, the emulsion polymerization or suspension polymerization may preferably be adopted.

Of these, in the emulsion polymerization method, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

On the other hand, in the suspension polymerization method, it is possible to obtain a product resin composition in a uniform state of pearls containing a medium- or high-molecular weight component uniformly mixed with a low-molecular weight component and a crosslinked component by polymerizing a vinyl monomer (mixture) containing a low-molecular weight polymer together with a crosslinking agent in a suspension state.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50°–95° C. and selected depending on the polymerization initiator used and the objective polymer. The polymerization initiator should be insoluble or hardly soluble in water, and may be used in an amount of 0.5–10 wt. parts per 100 wt. parts of the vinyl monomer (mixture).

Examples of the initiator may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylonitrile, 2,2'-azobis(2-methylbutyronitrile, 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy)hexane, di-t-butyldiperoxyisophthalate, 2,2-bis(4,4-di-t-butylperoxycyclohexyl)-propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di-(t-butylperoxy)hexane, diethylene glycol-bis(t-butylperoxycarbonate), di-t-butylperoxytrimethylazipate, tris(t-butylperoxy)triazine, and vinyl-tris(t-butylperoxy)silane. These initiators may be used singly or in combination.

In the present invention, the molecular weight distribution by GPC (gel permeation chromatography) of the toner may be measured by using THF (tetrahydrofuran) in the following manner.

A GPC sample is prepared as follows.

A resinous sample is placed in THF and left standing for several hours (e.g., 5–6 hours). Then, the mixture is sufficiently shaked until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.45–0.5 μm (e.g., "Maishoridisk H-25-5", available from Toso K.K.; and "Ekikurodisk 25CR", available from German Science Japan K.K.) to recover the filtrate as a GPC sample. The sample concentration is adjusted to provide a resin concentration within the range of 0.5–5 mg/ml.

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$), G2000H ($H_{XL}$), G3000H $H_{XL}$), G4000H $H_{XL}$), G5000H ($H_{XL}$), G6000H ($H_{XL}$), G7000H ($H_{XL}$) arid TSK guardcolumn available from Toso K.K.

The toner according to the present invention can further contain a negative or positive charge control agent.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols. Among the above, monoazo metal complexes are preferred.

Examples of the positive charge control agents may include: nigrosine and modified products thereof with aliphatic acid metal salts, etc., onium salts inclusive of quarternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungstic-molybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among these, nigrosine compounds and organic quarternary ammonium salts are particularly preferred.

It is preferred to use the toner according to the present invention together with silica fine powder blended therewith in order to improve the charge stability, developing characteristic and fluidity.

The silica fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred: an abrasive, such as cerium oxide, silicon carbide or strontium titanate, of which strontium titanate is preferred; a flowability-imparting agent, such as titanium oxide or aluminum oxide, of which a hydrophobic one is preferred: an anti-caking agent, and an electroconductivity-imparting agent, such as carbon black, zinc oxide, antimony oxide, or tin oxide. It is also possible to use a small amount of white or black fine particles having a polarity opposite to that of the toner as a development characteristic improver.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–5 wt. %.

The carrier used for this purpose may be a known one, examples of which may include: powder having magnetism, such as iron powder, ferrite powder, and nickel powder and carriers obtained by coating these powders with a resin, such as a fluorine-containing resin, a vinyl resin or a silicone resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of at most 2 μm, preferably 0.1–0.5 μm, further preferably 0.1–0.3 μm.

The magnetic material may preferably show magnetic properties under application of 10 kilo-Oersted, inclusive of: a coercive force of 20–300 Oersted, a saturation magnetization of 50–200 emu/g, and a residual magnetization of 2–20 emu/g. The magnetic material may be contained in the toner in a proportion of 20–200 wt. parts, preferably 40–150 wt. parts, per 100 wt. parts of the resin component.

The toner according to the present invention can contain a colorant which may be an appropriate pigment or dye.

Examples of the pigment may include: carbon black, aniline black, acetylene black, Naphthol Yellow, Hansa Yellow, Rhodamine Lake, Alizarin Lake, red iron oxide, Phthalocyanine Blue, and indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the wax, a metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification.

The thus obtained toner may be further blended with other external additives, as desired, sufficiently by means of a mixer such as a Henschel mixer to provide a toner for developing electrostatic images.

The toner according to the present invention may be fixed under heating onto a transfer material, such as plain paper or a transparent sheet for providing a transparency for an overhead projection (OHP), by using a contact heat-fixing means.

Figure 21:
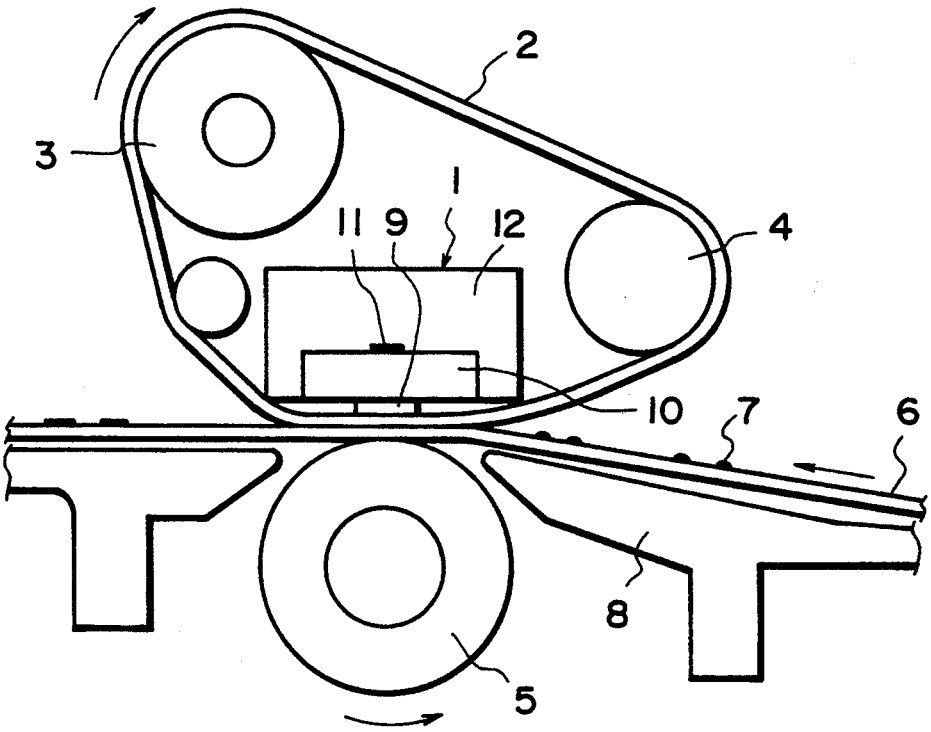
FIG. 21 is an illustrative view of an embodiment of the fixing apparatus for practicing the heat-fixing method according to the invention.

The contact heat-fixing means may include, for example, a fixing device including a heating and pressing roller or a fixing device, e.g., as shovel in FIG. 21 including a fixedly supported heating member 1 and a pressing member 5 disposed opposite to the heating member so as to press a transfer 6 material against the heating member by the medium of a film 2.

In the fixing device shown in FIG. 21, the heating member 1 has a linear heating part 9 which has a smaller heat capacity than a conventional hot roller and the heating part may preferably be heated to a maximum temperature of 100°–300° C.

The film 2 disposed between the heating member 1 and the pressing member 5 may comprise a 1–100 μm-thick heat-resistant sheet which may for example be a sheet of a heat-resistance polymer, such as polyester inclusive of PET (polyethylene terephthalate), PFA (tetrafluoroethylene-perfluoroalkyl vinyl ether copolymer), PTFE (polytetrafluoroethylene), polyimide or polyamide, a sheet of a metal such as aluminum, or a laminate sheet of a metal sheet and a polymer sheet.

The film 2 may preferably comprise a release layer and/or a low-resistivity layer in addition to the heat-resistant sheet.

A more specific embodiment of the fixing device is described with reference to FIG. 21.

A low-heat capacity linear heating member 1 comprises an aluminum substrate 10 measuring 1.0 mm in thickness, 10 mm in width and 240 mm in length embedded within an insulating material 12 and a heating part 9 of a resisting material applied in a width of 1.0 mm on the aluminum substrate 10 to which a current is supplied from its both longitudinal ends. More specifically, pulse signals of DC 100 V and a cyclic period of 20 mm are applied with a pulse width varying generally in the range of 0.5 msec–5 msec depending on desired temperature and energy discharge based on signals from a temperature-detecting element 11. In contact with the heating member 1 controlled with respect to the discharge energy and temperature, the fixing film 2 may be moved in the direction of an arrow.

A specific example of the fixing film 2 may include an endless film comprising a 20 μm-thick heat-resistant film of, e.g., polyimide, polyether imide, PES, PFA, coated on its side contacting the transfer material 6 with a 10 μm-thick release layer comprising a fluorine-containing resin, such as PTFE or PFA, to which an electroconductive substance is added. Generally, the total thickness may preferably be below 100 μm, more preferably below 40 μm. The film 2 may be driven without wrinkle or slackening in the arrow direction under tension by a drive roller 3 and a mating roller 4.

A pressing roller 5 having an elastomeric layer of, e.g., silicone rubber having a good releasability, is disposed opposite to the heating member 1 so as to apply a total pressure of 4–20 kg against the heating member 1 by the medium of the film 2 while rotating to move in association with the film 2. A yet-unfixed toner image 7 on a transfer material is guided by an inlet guide 8 to the fixing position where a fixed image is formed under heating as described above.

In the above embodiment, the fixing film 2 is described as an endless film but can be a film having ends spanning between a sheet-feeding shaft and a winding shaft.

Such a fixing device using a fixing film may be generally applied to an image forming apparatus using a toner, such as a copying machine, a printer or a facsimile apparatus.

Hereinbelow, the present invention will be described more specifically based on Examples.

Preparation of Waxes

Waxes A1, B1, C1, D1 and E1 used in Examples 1–5 and waxes F1, G1, H1 and I1 used in Comparative Examples 1–6 were prepared in the following manner.

Hydrocarbon wax F1 (comparative) was synthesized by the Arge process, and waxes A1, B1 and C1 (invention) were respectively prepared by fractional crystallization of the wax F1. Wax G1 (comparative) was prepared by oxidizing hydrocarbon prepared by the Arge process.

Wax H1 (comparative) of a relatively low molecular weight was prepared by polymerizing ethylene at a low pressure in the presence of a Ziegler catalyst, and wax D1 (invention) was prepared by fractional crystallization of the wax H1 for removing a low-molecular weight component to some extent. Wax I1 (comparative) of a higher molecular weight was prepared by similar polymerization, and wax E1 (invention) was prepared by fractional crystallization thereof for removal of low-molecular weight fraction.

The properties of these waxes are summarized in the following Tables 1–3.

TABLE 1

DSC Characteristic of Waxes

| Wax | On heating: On set temp. (°C.) | On heating: Absorption peak temp.* (°C.) | On cooling: Max. heat-evolution peak temp. (°C.) | On cooling: Temp. difference (°C.) |
|---|---|---|---|---|
| A1 | 67 | 104, 112 | 103 | 1 (104–103) |
| B1 | 69 | 106, 113 | 105 | 1 (106–105) |
| C1 | 64 | 101, 112 | 102 | 1 (102–101) |
| D1 | 62 | 105, 115 | 107 | 2 (107–105) |
| E1 (Comp.) | 88 | 116 | 110 | 6 (116–110) |
| F1 | 66 | 82, 107 | 96 | 11 (107–96) |
| G1 | 65 | 83, 105 | 94 | 11 (105–94) |
| H1 | 42 | 101, 114 | 104 | 3 (104–101) |
| I1 | 94 | 126 | 114 | 12 (126–114) |

*The underlined data refers to a maximum heat-absorption peak temperature.

TABLE 2

Molecular Weight Distribution of Waxes

| Wax | Mn | Mw | Mw/Mn | Mp |
|---|---|---|---|---|
| A1 | 790 | 1300 | 1.65 | 1110 |
| B1 | 900 | 1400 | 1.56 | 1320 |
| C1 | 650 | 1100 | 1.69 | 960 |
| D1 | 580 | 1200 | 2.07 | 1050 |
| E1 (Comp.) | 610 | 1650 | 2.70 | 1580 |
| F1 | 560 | 870 | 1.55 | 630 |
| G1 | 480 | 840 | 1.75 | 600 |
| H1 | 450 | 1150 | 2.56 | 500 |
| I1 | 720 | 3000 | 4.17 | 2000 |

TABLE 3

Properties of Waxes

| Wax | Penetration $10^{-1}$ mm | Density g/cm$^3$ | Melt viscosity cP | Softening point °C. | Acid value mg KOH/g |
|---|---|---|---|---|---|
| A1 | 0.5 | 0.96 | 15 | 117 | 0.1 |
| B1 | 0.5 | 0.96 | 18 | 118 | 0.1 |
| C1 | 0.5 | 0.96 | 13 | 115 | 0.1 |
| D1 | 1.5 | 0.95 | 11 | 116 | 0.1 |
| E1 (Comp.) | 1 | 0.97 | 28 | 120 | 0.1 |
| F1 | 1.5 | 0.94 | 10 | 110 | 0.1 |
| G1 | 3 | 0.96 | 8 | 102 | 10.0 |
| H1 | 2 | 0.95 | 15 | 122 | 0.1 |
| I1 | 1 | 0.97 | 80 | 128 | 0.1 |

Preparation of Binder Resins

Synthesis Example 1

| | |
|---|---|
| Styrene | 80 wt. part(s) |
| Butyl acrylate | 20 wt. part(s) |
| 2,2-Bis(4,4-di-t-butylperoxy-cyclohexyl)propane | 0.2 wt. part(s) |

A polymer A1 was prepared from the above materials by suspension polymerization.

| | |
|---|---|
| Styrene | 82 wt. part(s) |
| Butyl acrylate | 18 wt. part(s) |
| Di-t-butyl peroxide | 2.0 wt. part(s) |

A polymer B1 was prepared from the above materials by solution polymerization in xylene, and the polymers A1 and B1 were mixed in solution in a weight ratio of 30:70 to obtain a binder resin 1.

Synthesis Example 2

| | |
|---|---|
| Styrene | 80 wt. part(s) |
| Butyl acrylate | 20 wt. part(s) |
| Benzoyl peroxide | 0.25 wt. part(s) |

A polymer C1 was prepared from the above materials by suspension polymerization.

| | |
|---|---|
| Styrene | 83 wt. part(s) |
| Butyl acrylate | 17 wt. part(s) |
| Di-t-butyl peroxide | 2.5 wt. part(s) |

A polymer D1 was prepared from the above materials by solution polymerization in xylene, and the polymers C1 and D1 were mixed in solution in a weight ratio of 25:75 to obtain a binder resin 2.

Synthesis Example 3

| | |
|---|---|
| Styrene | 80 wt. part(s) |
| Butyl acrylate | 20 wt. part(s) |
| Benzoyl peroxide | 0.2 wt. part(s) |

A polymer E1 was prepared from the above materials by suspension polymerization.

| | |
|---|---|
| Styrene | 82 wt. part(s) |
| Butyl acrylate | 18 wt. part(s) |
| Di-t-butyl peroxide | 3.0 wt. part(s) |

A polymer F1 was prepared from the above materials by solution polymerization in xylene, and the polymers E1 and F1 were mixed in solution in a weight ratio of 40:60 to obtain a binder resin 3.

Synthesis Example 4

| | |
|---|---|
| Styrene | 80 wt. part(s) |
| Butyl acrylate | 20 wt. part(s) |
| Benzoyl peroxide | 0.3 wt. part(s) |

A binder resin 4 was prepared from the above materials by solution polymerization in xylene.

Synthesis Example 5

A binder resin 5 was prepared by mixing in solution the polymes A1 and B1 in a weight ratio of 60:40.

Synthesis Example 6

| | |
|---|---|
| Polymer B1 | 25 wt. part(s) |
| Styrene | 59.8 wt. part(s) |
| Butyl acrylate | 15 wt. part(s) |
| Divinylbenzene | 0.2 wt. part(s) |

-continued

| | |
|---|---|
| Benzoyl peroxide | 0.5 wt. part(s) |

A binder resin 5 was prepared from the above materials by suspension polymerization.

Example 1

| | |
|---|---|
| Binder resin 1 | 100 wt. part(s) |
| Magnetic iron oxide (Da (average particle size) = 0.25 μm, $\sigma_s$ (saturation magnetization) = 80 emu/g, under 10 kOe, $\sigma_r$ (residual magnetization) = 10 emu/g, Hc (coercive force) = 120 Oe (Oersted)) | 80 wt. part(s) |
| Nigrosine | 2 wt. part(s) |
| Wax A1 | 4 wt. part(s) |

The above ingredients were blended preliminarily and melt-kneaded through a twin-screw kneading extruder set at 130° C. The kneaded product was cooled, coarsely crushed, finely pulverized by a pulverizer using jet air, and classified by a wind-force classifier to obtain a toner 1 having a weight-average particle size of 8 μm. The toner was subjected Go the GPC measurement and DSC measurement to provide results as shown in Tables 4 and 5 appearing hereinafter.

EXAMPLES 2–5

Toners 2–5 were prepared in the same manner as in Example 1 except that binder resins and waxes shown in Table 6 were respectively used. The results of the GPC measurement and DSC measurement of the toners are also shown in Tables 4 and 5.

COMPARATIVE EXAMPLES 1–4

Comparative toners 1–4 were prepared in the same manner as in Example 1 except that binder resins and waxes shown in Table 6 were respectively used. The results of the GPC measurement and DSC measurement of the toners are also shown in Tables 4 and 5.

COMPARATIVE EXAMPLE 5

A comparative toner 5 was prepared in the same manner as in Example 1 except that the wax was omitted. The results of the GPC measurement and the DSC measurement of the toner are also shown in Tables 4 and 5. The heat absorption peak shown in Table 5 for the toner originated from the binder resin and similar peaks were also observed with respect to the other toners.

Each of the above toners and comparative toners in an amount of 100 wt. parts was blended with 0.6 wt. part of a positively chargeable hydrophobic colloidal silica to obtain a developer, which was then subjected to the following tests.

Fixing and Offset Test

Each developer was charged in a commercially available copying machine ("NP-1215", mfd. by Canon K.K.) to obtain yet-unfixed images which were then subjected to fixing and offset test by passing through an external hot roller fixing device capable of temperature control and comprising a teflon-coated upper roller and a silicone rubber-coated lower layer under the conditions of a nip=3.0 mm, a linear pressure=0.5 kg/cm and a process speed=50 mm/sec within a temperature range of 100°–230° C. at an increment of 5° C. for temperature control. For evaluation of low-temperature offset and fixability, paper of 80 g/m$^2$ was used and, for evaluation of high-temperature offset and fixability, paper of 52 g/m$^2$ was used. The fixability was evaluated by rubbing the toner image with a lens cleaning paper ("Dasper" (trade name), made by Ozu Paper Co., Ltd.) under a weight of 50 g/cm$^2$ and then evaluating the degree of peeling of the toner image. A fixing initiation temperature was defined as a temperature giving a decrease in reflection density after rubbing of below 10%. Offset was evaluated by eye observation to measure lower offset-free points and higher offset-free points between which offset was not caused. The results are summarized in Table 6 which shows the fixing initiation temperature ($T_{FI}$), a density lowering between before and after rubbing after fixing at 150° C., a lower offset-free temperature ($T_{OFL}$), a higher offset-free temperature ($T_{OFH}$) and a non-offset range ($T_{non\text{-}off}=T_{OFH}-T_{OFL}$),

Anti-blocking Characteristic

About 20 g of each developer was placed in a 100 cc-plastic cup and left standing for 3 days at 50° C. Thereafter, the anti-blocking characteristic was evaluated by eye observation based on the following standards.

Excellent (◎): No agglomerate is observed.

Good (): Agglomerate is observed but collapses easily.

Fair (Δ): Agglomerate is observed but is collapsed by shaking.

Non-acceptable (x): Agglomerate can be grasped and is not collapsed easily.

The results are also shown in Table 6.

Developing Performance

About 100 g of each developer was placed in a 500 cc-plastic cup and left standing for 3 days at 45° C. Then, the developer was charged in a commercially available copying machine ("FC-5II", mfd. by Canon K.K.) to evaluate the developing performance in terms of image density and fog. The results are shown in Table 6, wherein the symbols for evaluation of fog were as follows:

◎: excellent, : good, Δ: fair, x: not acceptable.

The above test is used as a simulation test for evaluating the durability against a temperature elevation in a machine and the stability under long-term standing.

Further, each of the developers obtained from the toners 1–5 of the invention was charged in a commercially available electrophotographic copying machine ("FC-2", mfd. by Canon K.K.) and used for image formation. At an environmental temperature of 7.5° C., a first copy immediately after turning on the power was obtained with a good fixability (density decrease: below 5%) without low-temperature offset.

At an environmental temperature of 23.5° C., after continuous image formation on 50 post cards, the developer was used for image formation on paper of 52 g/m$^2$, whereby no offset was observed due to temperature elevation at ends of the fixing device. As a result of copying test at an environmental temperature of 32.5° C., clear images were always formed to use all the toner up without causing melt-sticking or blocking at the cleaner part.

EXAMPLE 1A

| | |
|---|---|
| Binder resin 6 | 100 wt. part(s) |
| Magnetization oxide (same as in Example 1) | 85 wt. part(s) |
| Nigrosine | 2 wt. part(s) |
| Wax A1 | 4 wt. part(s) |

A toner 6 having a weight-average particle size of 8 μm was prepared from the above ingredients otherwise in the manner as in Example 1. According to the GPC measurement, the toner 6 showed a molecular weight distribution including a peak P1 at $1.52\times10^4$ and a peak P2 of $2.55\times10^6$.

100 wt. parts of the toner was blended with 0.5 wt. part of hydrophobic colloidal silica to obtain a developer. The developer was charged in a commercially available copying machine "NP-3825", mfd. by Canon K.K.). In an environment of 15° C., the copying machine in a sufficiently cooled state was supplied with a power and, after 5 min. in the standby state, was used for successive image formation on 150 sheets of A3-size transfer paper (80 g paper), whereby good images were formed without offset and with good fixability (density decrease=12%) even on the 150 - the sheet. As a result of successive copying of $2\times10^4$ sheets, good images having image densities of 1.32–1.36 and free from fog were obtained without melt sticking.

TABLE 4

| | Binder resin | Wax | Molecular weight distribution of toners: $3\times10^3-5\times10^4$ peak (P1) | $\geqq10^5$ peak (P2) | $\leqq10^5$ weight fraction (%) | Peak height ratio H1:H2:H3 |
|---|---|---|---|---|---|---|
| Toner | | | | | | |
| 1 | 1 | A1 | 13,500 | 620,000 | 76 | 12:1:4.5 |
| 2 | 2 | B1 | 12,100 | 670,000 | 81 | 15:1:3.5 |
| 3 | 3 | C1 | 9,600 | 780,000 | 68 | 9.5:1:4.0 |
| 4 | 1 | D1 | 12,900 | 638,000 | 77 | 11:1:4.8 |
| 5 | 2 | E1 | 10,800 | 662,000 | 83 | 17:1:2.5 |
| Comp. toner | | | | | | |
| 1 | 1 | F1 | 11,300 | 596,000 | 79 | 13:1:4.2 |
| 2 | 2 | G1 | 9,850 | 671,000 | 82 | 16:1:4.0 |
| 3 | 3 | H1 | 8,900 | 749,000 | 65 | 8.8:1:3.6 |
| 4 | 1 | I1 | 12,800 | 625,000 | 71 | 11:1:5.1 |
| 5 | 1 | None | 14,200 | 630,000 | 74 | 14:1:4.0 |

TABLE 5

| | Binder resin | Wax | DSC characteristics of toners: On heating: Rising temp. (°C.) | Onset temp. (°C.) | $T_{HAP}$* (°C.) | On cooling: $T_{HEP}$* (°C.) | Intensity ratio ($\times 10^{-3}$) |
|---|---|---|---|---|---|---|---|
| Toner | | | | | | | |
| 1 | 1 | A1 | 87 | 96 | 107 | 70 | 25.5 |
| 2 | 2 | B1 | 90 | 98 | 110 | 69 | 32.0 |
| 3 | 3 | C1 | 85 | 93 | 104 | 72 | 28.5 |
| 4 | 1 | D1 | 82 | 100 | 115 | 70 | 12.2 |
| 5 | 2 | E1 | 95 | 102 | 118 | 68 | 20.7 |
| Comp. toner | | | | | | | |
| 1 | 1 | F1 | 74 | 76 | 100 | 65 | 47.5 |
| 2 | 2 | G1 | 70 | 75 | 96 | 62 | 38.2 |
| 3 | 3 | H1 | 73 | 84 | 105 | 66 | 2.9 |
| 4 | 1 | I1 | 108 | 112 | 125 | 75 | 16.4 |
| 5 | 1 | None | 43 | 52 | 64 | — | — |

$T_{HAP}$*: Heat-absorption peak temperature
$T_{HEP}$*: Heat-evolution peak temperature

TABLE 6

| | Toner | Binder resin | Wax | Evaluation of fixability, storability and developing performance: Fixability: $T_{FI}$ (°C.) | Density decrease (%) at 150° C. | Anti-offset: $T_{OFL}$ (°C.) | $T_{OFH}$ (°C.) | $T_{non\text{-}off}$ (°C.) | Anti-blocking | Developing performance: Image density | Fog |
|---|---|---|---|---|---|---|---|---|---|---|---|
| Ex. | Toner | | | | | | | | | | |
| 1 | 1 | 1 | A1 | 125 | 2.5 | 115 | 205 | 90 | ◎ | 1.35 | ◎ |
| 2 | 2 | 2 | B1 | 120 | 2 | 115 | 205 | 90 | ◎ | 1.34 | ○ |
| 3 | 3 | 3 | C1 | 130 | 3.5 | 120 | 210 | 90 | ○ | 1.36 | ◎ |
| 4 | 4 | 1 | D1 | 125 | 4 | 120 | 200 | 80 | ○ | 1.33 | ○ |
| 5 | 5 | 2 | E1 | 130 | 5.5 | 120 | 205 | 85 | ◎ | 1.37 | ○ |
| Comp Ex. | Comp. toner | | | | | | | | | | |
| 1 | 1 | 1 | F1 | 120 | 2.5 | 115 | 190 | 75 | Δ | 1.29 | Δ |
| 2 | 2 | 2 | G1 | 115 | 1.5 | 110 | 185 | 75 | X | 1.13 | Δ |
| 3 | 3 | 3 | H1 | 125 | 4.5 | 120 | 195 | 75 | Δ | 1.24 | Δ |
| 4 | 4 | 1 | I1 | 150 | 9.5 | 140 | 210 | 70 | ○ | 1.28 | ○ |
| 5 | 5 | 1 | None | 145 | 8.5 | 140 | 180 | 40 | ◎ | 1.32 | ○ |

Preparation of Waxes

Waxes A2, B2, C2 and D2 used in Examples 6–9 and wax E2 used in Comparative Examples 6 were prepared as follows.

Waxes A2, B2 and C2 (invention) were obtained from hydrocarbon synthesized by the Arge process, and Wax D2 (invention) was obtained from Polyethylene obtained by low-pressure polymerization in the presence of a Ziegler catalyst. Wax E2 (comparative) was prepared by thermal decomposition of polyethylene.

The properties of the waxes are summarized in the following Tables 7-1, 7-2 and 8.

TABLE 7-1

| Wax | DSC characteristics of waxes: $(T_{HEP})$max (°C.) | $T_{HAP}$ (°C.) | $W_{\frac{1}{2}}$ (°C.) | ΔT | $(T_{onset})$HA |
|---|---|---|---|---|---|
| A2 | 83 | 81 | 21 | 2 | 64 |
| B2 | 82 | 88 | 17 | 6 | 66 |
| C2 | 102 | 103 | 24 | 1 | 68 |
| D2 | 102 | 99 | 36 | 3 | 57 |
| Comp. E2. | 103 | 89 | 7 | 14 | 26 |

$(T_{HEP})$max: Maximum heat-evolution peak temperature on cooling.
$T_{HAP}$: Heat-absorption peak temperature on heating corresponding to $(T_{HEP})$max.
$W_{\frac{1}{2}}$: Half-value width of the maximum heat evolution peak.
ΔT: Temperature difference (= $|(T_{HEP})\max - T_{HAP}|$)
$(T_{onset})$HA: Onset temperature of the heat absorption peak.

TABLE 7-2

| Wax | Molecular weight distribution of waxes: Mn | Mw | Mw/Mn |
|---|---|---|---|
| A2 | 490 | 720 | 1.47 |
| B2 | 450 | 670 | 1.49 |
| C2 | 800 | 1270 | 1.59 |
| D2 | 470 | 900 | 1.91 |
| Comp. E2 | 910 | 5630 | 6.19 |

TABLE 8

| Wax | Properties of waxes: Penetration $10^{-1}$ mm | Density g/cm$^3$ | Melt viscosity cP | Softening temp. °C. | Crystallinity % |
|---|---|---|---|---|---|
| A2 | 2.0 | 0.94 | 6 | 95 | 89 |
| B2 | 4.0 | 0.94 | 5 | 93 | 89 |
| C2 | 0.5 | 0.96 | 14 | 110 | 88 |
| D2 | 3.0 | 0.95 | 9 | 117 | 91 |
| Comp. E2 | 4.5 | 0.93 | 180 | 105 | 75 |

Preparation of Binder Resins

Synthesis Example 7

| | |
|---|---|
| Styrene | 80 wt. part(s) |
| n-Butyl acrylate | 20 wt. part(s) |
| 2,2-Bis(4,4-di-t-butylperoxy- | 0.2 wt. part(s) |

-continued

| |
|---|
| cyclohexyl)propane |

A polymer A2 was prepared from the above materials by suspension polymerization.

| | |
|---|---|
| Styrene | 83 wt. part(s) |
| Butyl acrylate | 17 wt. part(s) |
| Di-t-butyl peroxide | 1.0 wt. part(s) |

A polymer B2 was prepared from the above materials by solution polymerization in xylene, and the polymers A2 and B2 were mixed in solution in a weight ratio of 30:70 to obtain a binder resin 7.

Synthesis Example 8

| | |
|---|---|
| Styrene | 80 wt. part(s) |
| n-Butyl acrylate | 20 wt. part(s) |
| 2,2-Bis(4,4-di-t-butylperoxy-cyclohexyl)propane | 0.1 wt. part(s) |

A polymer C2 was prepared from the above materials by suspension polymerization.

| | |
|---|---|
| Styrene | 84 wt. part(s) |
| Butyl acrylate | 16 wt. part(s) |
| Di-t-butyl peroxide | 0.8 wt. part(s) |

A polymer D2 was prepared from the above materials by solution polymerization in xylene, and the polymers C2 and D2 were mixed in solution in a weight ratio of 25:75 to obtain a binder resin 8.

Synthesis Example 9

| | |
|---|---|
| Styrene | 80 wt. part(s) |
| n-Butyl acrylate | 20 wt. part(s) |
| 2,2-Bis(4,4-di-t-butylperoxy-cyclohexyl)propane | 0.2 wt. part(s) |

A polymer E2 was prepared from the above materials by suspension polymerization.

| | |
|---|---|
| Styrene | 82 wt. part(s) |
| Butyl acrylate | 18 wt. part(s) |
| Di-t-butyl peroxide | 4.0 wt. part(s) |

A polymer F2 was prepared from the above materials by solution Polymerization in xylene, and the polymers E2 and F2 were mixed in solution in a weight ratio of 40:60 to obtain a binder resin 9.

Synthesis Example 10

| | |
|---|---|
| Styrene | 80 wt. part(s) |
| Butyl acrylate | 20 wt. part(s) |
| Di-t-butyl peroxide | 0.5 wt. part(s) |

A binder resin 10 was prepared from the above materials by solution polymerization in xylene.

Synthesis Example 11

| | |
|---|---|
| Polymer B2 | 30 wt. part(s) |
| Styrene | 44.7 wt. part(s) |
| Butyl acrylate | 25 wt. part(s) |
| Divinylbenzene | 0.3 wt. part(s) |
| Di-t-butylperoxy-2-ethyl-hexanoate | 0.7 wt. part(s) |

A binder resin 11 was prepared from the above materials by suspension polymerization.

EXAMPLE 6

| | |
|---|---|
| Binder resin 7 | 100 wt. part(s) |
| Magnetic iron oxide ($Da = 0.25\ \mu m$, $\sigma_s = 80$ emu/g under 10 kOe, $\sigma_r = 10$ emu/g, Hc = 120 Oe) | 80 wt. part(s) |
| Nigrosin | 2 wt. part(s) |
| Wax A2 | 4 wt. part(s) |

The above ingredients were blended preliminarily and melt-kneaded through a twin-screw kneading extruder set at 130° C. The kneaded product was cooled, coarsely crushed, finely pulverized by a pulverizer using jet air, and classified by a wind-force classifier to obtain a toner 1 having a weight-average particle size of 8 μm. The toner was subjected to the GPC measurement to provide results as shown in Table 9 appearing hereinafter.

EXAMPLES 7–9

Toners 7–9 were prepared in the same manner as in Example 6 except that binder resins and waxes shown in Table 10 were respectively used. The results of the GPC measurement are also shown in Table 9.

Comparative Examples 6 and 7

Comparative toners 6 and 7 were prepared in the same manner as in Example 6 except that binder resin and waxes shown in Table 10 were respectively used. The results of the GPC measurement are also shown in Table 9.

COMPARATIVE EXAMPLE 8

A comparative toner 8 was prepared in the same manner as in Example 6 except that the wax was replaced by a low-molecular weight polypropylene wax ("Viscol 550P", mfd. by Sanyo Kasei Kogyo K.K.).

Each of the above toners and comparative toners in an amount of 100 wt. parts was blended with 0.6 wt. part of a positively chargeable hydrophobic colloidal silica to obtain a developer, which was then subjected to the fixing and offset test and evaluation of the anti-blocking characteristic and developing performance in the same manner as in Example 1 except that the fixing and offset test was performed under the varied conditions of a nip=4.5 mm, a linear pressure of 0.6 kg/cm$^2$ and a process speed of 90 mm/sec, and the developing performance was evaluated without the standing at 45° C.

The results are shown in Tables 10 and 11.

TABLE 9

| | Molecular weight distribution of toners | | | |
|---|---|---|---|---|
| | Toner | $3 \times 10^3$–$5 \times 10^4$ peak* | $\geqq 10^5$ peak | $\leqq 10^5$ weight fraction (%) |
| Ex. 6 | 6 | 10,500 | 610,000 | 76 |

TABLE 9-continued

| | Molecular weight distribution of toners | | | |
|---|---|---|---|---|
| | Toner | $3 \times 10^3$–$5 \times 10^4$ peak* | $\geqq 10^5$ peak | $\leqq 10^5$ weight fraction (%) |
| Ex. 7 | 7 | 12,800 | 670,000 | 80 |
| Ex. 8 | 8 | 5,700 | 580,000 | 69 |
| Ex. 9 | 9 | 10,400 | 600,000 | 77 |
| Ex. 10 | 10 | 15,400 | 2,800,000 | 63 |
| Comp. Ex. 6 | Comp. 6 | 10,600 | 590,000 | 77 |
| Comp. Ex. 7 | Comp. 7 | 10,300 | 570,000 | 78 |
| Comp. Ex. 8 | Comp. 8 | 10,400 | 560,000 | 77 |

*The underline refers to a maximum peak.

TABLE 10

| | | | | Fixing performances | | | |
|---|---|---|---|---|---|---|---|
| | | | | | Anti-offset | | |
| | Toner | Binder resin | Wax | $T_{FI}$ (°C.) | $T_{OFL}$ (°C.) | $T_{OFH}$ (°C.) | $T_{non\text{-}offset}$ range (°C.) |
| Ex. | Toner | | | | | | |
| 6 | 6 | 7 | A2 | 130 | 125 | 205 | 80 |
| 7 | 7 | 8 | B2 | 135 | 125 | 205 | 80 |
| 8 | 8 | 9 | C2 | 135 | 130 | 215 | 85 |
| 9 | 9 | 7 | D2 | 140 | 135 | 210 | 75 |
| Comp. Ex. | Comp. toner | | | | | | |
| 6 | 6 | 7 | E2 | 145 | 140 | 190 | 50 |
| 7 | 7 | 7 | none | 155 | 150 | 180 | 30 |
| 8 | 8 | 7 | 550P | 150 | 145 | 200 | 55 |

TABLE 11

| | | | | Storability and developing performance | | |
|---|---|---|---|---|---|---|
| | | | | | Developing performance | |
| | Toner | Binder resin | Wax | Anti-blocking | Image density | Fog |
| Ex. | Toner | | | | | |
| 6 | 6 | 7 | A2 | ◎ | 1.33 | ◎ |
| 7 | 7 | 8 | B2 | ○ | 1.36 | ◎ |
| 8 | 8 | 9 | C2 | ◎ | 1.39 | ◎ |
| 9 | 9 | 7 | D2 | ○ | 1.37 | ◎ |
| Comp. Ex. | Comp. toner | | | | | |
| 6 | 6 | 7 | E2 | Δ | 1.30 | Δ |
| 7 | 7 | 7 | none | ◎ | 1.37 | ◎ |
| 8 | 8 | 7 | 550P | ○ | 1.32 | Δ |

EXAMPLES 10–13, COMPARATIVE EXAMPLES 9–11

Each of the yet-unfixed toner images of the toners 6–9 and comparative toners 6–8 formed in Examples 6–9 and Comparative Examples 6–8 was subjected to fixing and offset test by using an external fixing device as shown in FIG. 21 including a heating member 1 and a pressing roller 5 disposed opposite to the heating member to press a transfer material onto the heating member 1 by the medium of a fixing film 2. The fixing film 2 was an endless film comprising a 20 μm-thick polyimide film coated with a 10 μm-thick release layer of a fluorine-containing resin to which an electroconductive substance was added. The pressing roller 5 comprised silicone rubber and was used to apply a total pressure of 10 kg at a nip of 4.0 mm and a process speed of 90 mm/sec. The film was driven under tension by a drive roller 3 and a mating roller 4, and the linear heating member 1 of a low heat capacity was temperature-controlled by applying energy pulses thereto. The evaluation of fixing performances were performed in the same manner as in Example 6 and the results thereof are shown in Table 12 below.

TABLE 12

| | | | | Fixing performances | | | |
|---|---|---|---|---|---|---|---|
| | | | | | Anti-offset | | |
| | Toner | Binder resin | Wax | $T_{FI}$ (°C.) | $T_{OFL}$ (°C.) | $T_{OFH}$ (°C.) | $T_{non\text{-}offset}$ range (°C.) |
| Ex. | Toner | | | | | | |
| 10 | 6 | 7 | A2 | 140 | 135 | 215 | 80 |
| 11 | 7 | 8 | B2 | 145 | 135 | 210 | 80 |
| 12 | 8 | 9 | C2 | 145 | 140 | 225 | 85 |
| 13 | 9 | 7 | D2 | 150 | 145 | 215 | 70 |
| Comp. Ex. | Comp. toner | | | | | | |
| 9 | 6 | 7 | E2 | 155 | 150 | 200 | 50 |
| 10 | 7 | 7 | none | 160 | 155 | 190 | 35 |
| 11 | 8 | 7 | 550P | 155 | 150 | 205 | 55 |

EXAMPLE 14

| | |
|---|---|
| Binder resin 11 | 100 wt. part(s) |
| Magnetization oxide (same as in Example 6) | 80 wt. part(s) |
| 3,5-Di-t-butylsalicylic acid Cr complex | 1 wt. part(s) |
| Wax A2 | 4 wt. part(s) |

A toner 10 having a weight-average particle size of 8 μm was prepared from the above ingredients otherwise in the manner as in Example 6. The toner 10 showed GPC data as shown in Table 9 above.

100 wt. parts of the toner was blended with 0.6 wt. part of hydrophobic colloidal silica to obtain a developer. The developer was charged in a commercially available copying machine "NP-8582", mfd. by Canon K.K.). In an environment of 15° C., the copying machine in a sufficiently cooled state was supplied with a power and, after 5 min. in the standby state, was used for successive image formation on 200 sheets of A3-size transfer paper (80 g paper), whereby good images were formed without offset and with good fixability (density decrease=5%) even on the 200th sheet. As a result of successive copying of $2\times10^4$ sheets, good images having image densities of 1.38–1.46 and free from fog were obtained without melt sticking.

Preparation of Waxes

Waxes A3, B3, C3, D3 and E3 used in Examples and waxes F3, G3, H3 and I3 used in Comparative Examples were prepared in the following manner.

Hydrocarbon wax F3 (comparative) was synthesized by the Arge process, and waxes A3, B3 and C3 (invention) were respectively prepared by fractional crystallization of the wax F3. Wax G3 (comparative) was prepared by oxidizing hydrocarbon prepared by the Arge process.

Wax H3 (comparative) of a relatively low molecular weight was prepared by polymerizing ethylene at a low pressure in the presence of a Ziegler catalyst, and wax D3 (invention) was prepared by fractional crystallization of the wax H1 for removing a low-molecular weight component to some extent. Wax I3 (comparative) of a higher molecular weight than the wax H3 was prepared by similar polymerization, and wax E3 (invention) was prepared by fractional crystallization thereof for removal of low-molecular weight fraction.

The properties of these waxes are summarized in the following Tables 13–15.

TABLE 13

| DSC Characteristic of Waxes | | | | |
|---|---|---|---|---|
| | On heating | | On cooling | |
| Wax | On set temp. (°C.) | Absorption peak temp.* (°C.) | Max. heat-evolution peak temp. (°C.) | Temp. difference (°C.) |
| A3 | 66 | 105, 112 | 104 | 1 (104–104) |
| B3 | 68 | 107, 113 | 106 | 1 (107–106) |
| C3 | 62 | 104, 112 | 105 | 1 (105–104) |
| D3 | 61 | 104, 116 | 106 | 2 (106–104) |
| E3 | 86 | 117 | 111 | 6 (117–111) |
| (Comp.) | | | | |
| F3 | 65 | 81, 106 | 95 | 11 (106–95) |
| G3 | 67 | 83, 104 | 96 | 11 (110–96) |
| H3 | 40 | 103, 116 | 105 | 2 (105–103) |
| I3 | 95 | 125 | 113 | 12 (125–113) |

*The underlined data refers to a maximum heat-absorption peak temperature.

TABLE 14

| Molecular Weight Distribution of Waxes | | | | |
|---|---|---|---|---|
| Wax | Mn | Mw | Mw/Mn | Mp |
| A3 | 780 | 1280 | 1.64 | 1100 |
| B3 | 910 | 1410 | 1.55 | 1330 |
| C3 | 620 | 1050 | 1.69 | 980 |
| D3 | 570 | 1170 | 2.05 | 1030 |
| E3 | 630 | 1750 | 2.78 | 1670 |
| (Comp.) | | | | |
| F3 | 540 | 830 | 1.54 | 600 |
| G3 | 510 | 850 | 1.67 | 610 |
| H3 | 470 | 1120 | 2.38 | 490 |
| I3 | 750 | 3200 | 4.27 | 2100 |

TABLE 15

| Properties of Waxes | | | | | |
|---|---|---|---|---|---|
| Wax | Penetration $10^{-1}$ mm | Density g/cm$^3$ | Melt viscosity cP | Softening point °C. | Acid value mgKOH/g |
| A3 | 0.5 | 0.96 | 14 | 116 | 0.1 |
| B3 | 0.5 | 0.96 | 18 | 118 | 0.1 |
| C3 | 0.5 | 0.96 | 12 | 114 | 0.1 |
| D3 | 1.5 | 0.96 | 12 | 118 | 0.1 |
| E3 | 1 | 0.97 | 30 | 122 | 0.1 |
| (Comp.) | | | | | |
| F3 | 1.5 | 0.94 | 8 | 108 | 0.1 |
| G3 | 2 | 0.96 | 10 | 105 | 10.0 |
| H3 | 2 | 0.96 | 15 | 120 | 0.1 |
| I3 | 1 | 0.97 | 88 | 129 | 0.1 |

EXAMPLE 15

| | |
|---|---|
| Styrene-butyl acrylate copolymer (copolymerization weight ratio = 80:20, Mn = about $10^4$) | 100 wt. part(s) |
| Magnetic iron oxide (Da = 0.25 μm, $\sigma_s$ = 80 emu/g under 10 kOe, $\sigma_r$ = 10 emu/g, Hc = 120 Oe) | 80 wt. part(s) |
| Nigrosin | 2 wt. part(s) |
| Wax A3 | 4 wt. part(s) |

The above ingredients were blended preliminarily and melt-kneaded through a twin-screw kneading extruder set at 130° C. The kneaded product was cooled, coarsely crushed, finely pulverized by a pulverizer using jet air, and classified by a wind-force classifier to obtain a toner 11 having a weight-average particle size of 8 μm. The toner was subjected to the DSC measurement to provide results as shown in Table 16 appearing hereinafter. The DSC curves on heating and cooling of the toner 11 are shown in FIGS. 5 and 6, respectively.

EXAMPLES 16–19

Toners 12–15 were prepared in the same manner as in Example 15 except that waxes B3–E3 were respectively used. The results of the DSC measurement of the toners are also shown in Table 16.

COMPARATIVE EXAMPLES 9–12

Comparative toners 9–12 were prepared in the same manner as in Example 15 except that waxes F3–I3 were respectively used. The results of the DSC measurement of the toners are also shown in Table 16.

COMPARATIVE EXAMPLE 13

A comparative toner 13 was prepared in the same manner as in Example 15 except that the wax was omitted. The results of the DSC measurement of the toner are also shown in Table 16. The heat absorption peak shown in Table 16 for the toner originated from the binder resin and similar peaks were also observed with respect to the other toners.

COMPARATIVE EXAMPLE 14

A comparative toner 14 was prepared in the same manner as in Example 15 except that the wax was replaced by a low-molecular weight polypropylene wax ("Viscol 550P", mfd. by Sanyo Kasei Kogyo K.K.).

Each of the above toners and comparative toners in an amount of 100 wt. parts was blended with 0.6 wt. part of a positively chargeable hydrophobic colloidal silica to obtain a developer, which was then subjected to the fixing and offset test and evaluation of the anti-blocking characteristic and developing performance in the same manner as in Example 1 except that the fixing and offset test was performed under the varied conditions of a nip=4.0 mm, a linear pressure of 0.4 kg/cm$^2$ and a process speed of 45 mm/sec.

The results are shown in Tables 17 and 18.

TABLE 16

| DSC characteristics of toners | | | | | | |
|---|---|---|---|---|---|---|
| | | On heating | | | On cooling | |
| Toner | Wax | Rising temp. (°C.) | Onset temp. (°C.) | $T_{HAP}$* (°C.) | $T_{HEP}$* (°C.) | Intensity ratio (× $10^{-3}$) |
| Toner | | | | | | |
| 11 | A3 | 89 | 99 | 109 | 69 | 30.5 |
| 12 | B3 | 90 | 101 | 112 | 70 | 33.3 |
| 13 | C3 | 87 | 96 | 106 | 68 | 27.7 |
| 14 | D3 | 84 | 101 | 116 | 68 | 13.9 |
| 15 | E3 | 98 | 103 | 117 | 72 | 18.3 |
| Comp. toner | | | | | | |
| 9 | F3 | 73 | 76 | 100 | 64 | 47.8 |
| 10 | G3 | 71 | 75 | 97 | 65 | 41.2 |
| 11 | H3 | 76 | 101 | 115 | 67 | 3.6 |
| 12 | I3 | 108 | 114 | 122 | 74 | 11.6 |
| 13 | none | 45 | 53 | 63 | — | — |
| 14 | 550P | 112 | 126 | 145 | 40 | 0.6 |

*$T_{HAP}$: Heat-absorption peak temperature
*$T_{HEP}$: Heat-evolution peak temperature

TABLE 17

| | | | Fixing performances | | | | |
|---|---|---|---|---|---|---|---|
| | | | Fixability | | | | |
| | | | | Density | Anti-offset | | |
| | Toner | Wax | $T_{FI}$ (°C.) | decrease (%) at 150° C. | $T_{OFL}$ (°C.) | $T_{OFH}$ (°C.) | $T_{non\text{-}offset}$ range (°C.) |
| Ex. | Toner | | | | | | |
| 15 | 11 | A3 | 120 | 3 | 115 | 205 | 90 |
| 16 | 12 | B3 | 120 | 3 | 115 | 205 | 90 |
| 17 | 13 | C3 | 120 | 2 | 115 | 200 | 85 |
| 18 | 14 | D3 | 125 | 6 | 120 | 200 | 80 |
| 19 | 15 | E3 | 130 | 7 | 120 | 200 | 80 |
| Comp. Ex. | Comp. toner | | | | | | |
| 9 | 9 | F3 | 120 | 3 | 115 | 195 | 80 |
| 10 | 10 | G3 | 120 | 3 | 115 | 185 | 70 |
| 11 | 11 | H3 | 125 | 4 | 120 | 195 | 75 |
| 12 | 12 | I3 | 135 | 8 | 130 | 200 | 70 |
| 13 | 13 | none | 160 | 15 | 150 | 180 | 30 |
| 14 | 14 | 550P* | 150 | 10 | 140 | 190 | 50 |

*550P: Low-molecular weight polypropylene wax

TABLE 18

| | | | Storability and developing performance | | |
|---|---|---|---|---|---|
| | | | | Developing performance | |
| | Toner | Wax | Anti-blocking | Image density | Fog |
| Ex. | Toner | | | | |
| 15 | 11 | A3 | ◎ | 1.38 | ◎ |
| 16 | 12 | B3 | ◎ | 1.38 | ◎ |
| 17 | 13 | C3 | ○ | 1.35 | ◎ |
| 18 | 14 | D3 | ○ | 1.32 | ○ |
| 19 | 15 | E3 | ◎ | 1.35 | ○ |
| Comp. Ex. | Comp. toner | | | | |
| 9 | 9 | F3 | Δ | 1.23 | Δ |
| 10 | 10 | G3 | X | 1.12 | Δ |
| 11 | 11 | H3 | Δ | 1.24 | Δ |
| 12 | 12 | I3 | ○ | 1.36 | ○ |
| 13 | 13 | none | ◎ | 1.37 | ○ |

polyimide film coated with a 10 μm-thick release layer of a fluorine-containing resin to which an electroconductive substance was added. The pressing roller 5 comprised silicone rubber and was used to apply a total pressure of 8 kg at a nip of 3.5 mm and a process speed of 50 mm/sec. The film was driven under tension by a drive roller 3 and a mating roller 4, and the linear heating member 1 of a low heat capacity was temperature-controlled by applying energy pulses thereto. The evaluation of fixing performances were performed in the same manner as in Example 15 and the results thereof are shown in Table 19 below.

As is understood from Tables 15–19, the toners containing waxes A3–C3 showed further improved performances than the toners containing the alkylene polymer-type waxes D3 and E3.

TABLE 19

| | | | Fixing performances | | | | |
|---|---|---|---|---|---|---|---|
| | | | Fixability | | | | |
| | | | | Density | Anti-offset | | |
| | Toner | Wax | $T_{FI}$ (°C.) | decrease (%) at 150° C. | $T_{OFL}$ (°C.) | $T_{OFH}$ (°C.) | $T_{non\text{-}offset}$ range (°C.) |
| Ex. | Toner | | | | | | |
| 20 | 11 | A3 | 130 | 2 | 120 | 215 | 95 |
| 21 | 12 | B3 | 130 | 2 | 120 | 215 | 95 |
| 22 | 13 | C3 | 130 | 2 | 120 | 210 | 90 |
| 23 | 14 | D3 | 135 | 6 | 125 | 205 | 80 |
| 24 | 15 | E3 | 135 | 5 | 125 | 205 | 80 |
| Comp. Ex. | Comp. toner | | | | | | |
| 15 | 9 | F3 | 130 | 3 | 120 | 200 | 80 |
| 16 | 10 | G3 | 130 | 3 | 120 | 190 | 70 |
| 17 | 11 | H3 | 135 | 3 | 125 | 200 | 75 |
| 18 | 12 | I3 | 140 | 8 | 135 | 205 | 70 |
| 19 | 13 | none | 155 | 12 | 150 | 180 | 30 |

EXAMPLES 20–24, COMPARATIVE EXAMPLES 15–19

Each of the yet-unfixed toner images of the toners 11–15 and comparative toners 9–13 formed in Examples 15–19 and Comparative Examples 9–13 was subjected to fixing and offset test by using an external fixing device as shown in FIG. 21 including a heating member 1 and a pressing roller 5 disposed opposite to the heating member to press a transfer material onto the heating member 1 by the medium of a fixing film 2. The fixing film 2 was an endless film comprising a 20 μm-thick

EXAMPLE 25

| | |
|---|---|
| Styrene-butyl acrylate (80:20) copolymer (Mn = about $10^4$) | 100 wt. part(s) |
| Copper phthalocyanine (colorant) | 4 wt. part(s) |
| Quaternary ammonium organic salt (positive charge control agent) | 1 wt. part(s) |
| Wax A3 | 3 wt. part(s) |

A toner 16 having a weight-average particle size of 8 μm was prepared from the above ingredients otherwise in the same manner as in Example 15. The toner 16 provided DSC data as shown Table 20 appearing hereinafter. The toner 16 in an amount of 100 wt. parts was blended externally with 1.0 wt. part of positively chargeable hydrophobic colloidal silica fine powder to form a toner. The toner in 10 wt. parts was further blended with 100 wt. parts of ferrite carrier coated with a resin mixture of styrene-acrylic resin and fluorine-containing resin to obtain a developer.

The developer was charged in a commercially available electrophotographic copying machine including a fixing device as shown in FIG. 21 ("FC-2", mfd. by Canon K.K.) and used for image formation. At an environmental temperature of 7.5° C., a first copy immediately after turning on the power was obtained with a good fixability (density decrease: below 5%) without low-temperature offset.

At an environmental temperature of 23.5° C., after continuous image formation on 50 post cards, the developer was used for image formation on paper of 52 g/m$^2$, whereby no offset was observed due to temperature elevation at ends of the fixing device. As a result of copying test at an environmental temperature of 32.5° C., clear blue images were always formed to use all the toner up without causing melt-sticking or blocking at the cleaner part. During the operation, the temperature in the apparatus was measured whereby 48° C. was measured in the neighborhood of the developing device and 52° C. was measured in the neighborhood of the cleaner. Further, a cartridge was left standing at 40° C. for 2 weeks and then evaluated for image formation, whereby clear blue images free of fog were obtained.

EXAMPLE 26

| | |
|---|---|
| Styrene-butyl acrylate (82:18) copolymar (Mn = about $10^4$) | 100 wt. part(s) |
| Magnetic ion oxide (Da = 0.25 μm) | 60 wt. part(s) |
| Monoazo Cr complex (negative charge control agent) | 1 wt. part(s) |
| Wax A3 | 4 wt. part(s) |

A magnetic toner 17 having a weight-average particle size of 12 μm was prepared from the above ingredients otherwise in the same manner as in Example 15. The toner 17 provided DSC data as shown Table 20 appearing hereinafter. The toner 17 in an amount of 100 wt. parts was blended externally with 0.4 wt. part of hydrophobic colloidal silica fine powder to form a developer.

The developer was charged in a commercially available laser beam printer using a hot roller fixing device ("Laser Shot B406", mfd. by Canon K.K.) and tested for image formation after removing the cleaning pad for the fixing roller.

As a result of the first copy test at an environmental temperature of 7.5° C., good fixability (density decrease: 3%) was obtained without offset.

A cartridge containing the developer was left standing at 40° C. for 2 weeks and then evaluated for successive image formation in an environment of 32.5° C., whereby fog-free clear toner images having image densities of 1.35–1.40 were obtained without melt-sticking until the toner was used up. Further, no staining was observed on the heating roller or pressing roller.

EXAMPLE 27

| | |
|---|---|
| Polyester (bisphenol A-type diol/terephthalic acid/trimellitic acid (50/45/5 by weight) condensate, Mn = about 5000) | 100 wt. part(s) |
| Magnetic iron oxide (Da = 0.25 μm) | 80 wt. part(s) |
| 3,5-Di-t-butylsalicylic acid Cr complex | 1 wt. part(s) |
| Wax A3 | 3 wt. part(s) |

A magnetic toner 18 having a weight-average particle size of 8 μm was prepared from the above ingredients otherwise in the same manner as in Example 15. The toner 18 provided DSC data as shown Table 20 appearing hereinafter. The toner 18 in an amount of 100 wt. parts was blended externally with 0.6 wt. part of hydrophobic colloidal silica fine powder to form a developer.

The developer was charged in a commercially available copying machine using a hot roller fixing device ("NP8582", mfd. by Canon K.K.). In an environment of 15° C., the copying machine in a sufficiently cooled state was supplied with a power and, after 5 min. in the standby state, was used for successive image formation on 200 sheets of A3-size transfer paper (80 g paper), whereby good images were formed without offset and with good fixability (density decrease=8%). As a result of successive image formation of solid black images, no winding-up was caused and the claw trace was only slight.

As a result of copying test of 20000 sheets in an environment of 32.5° C., fog-free images having image densities of 1.38–1.40 were obtained without causing melt-sticking.

TABLE 20

| | | DSC characteristics of toners | | | | |
|---|---|---|---|---|---|---|
| | | On heating | | | On cooling | |
| Toner | Wax | Rising temp. (°C.) | Onset temp. (°C.) | $T_{HAP}$* (°C.) | $T_{HEP}$* (°C.) | Intensity ratio (× $10^{-3}$) |
| Toner | | | | | | |
| 16 | A3 | 88 | 98 | 109 | 69 | 39.4 |
| 17 | A3 | 89 | 99 | 109 | 69 | 34.4 |
| 18 | A3 | 90 | 99 | 108 | 69 | 23.1 |

*$T_{HAP}$: Heat-absorption peak temperature
*$T_{HEP}$: Heat-evolution peak temperature

EXAMPLE 28

The toner 11 was evaluated by using a commercially available electrophotographic copying machine.

As a result of the first copy test at an environmental temperature of 7.5° C., good fixability (density decrease: 7%) was obtained without offset.

As a result of successive copying of 10000 sheets in an environment of 32.5° C., fog-free images having image densities of 1.36–1.41 were obtained continuously. No melt sticking was caused and the staining of the fixing roller cleaning pad was very little. When images were successively formed on 200 sheets of B5-size transfer paper (80 g/m$^2$) and, immediately thereafter, image was formed on A3-size transfer paper (52 g/m$^2$), no high-temperature offset was caused due to temperature elevation at fixing roller ends.

What is claimed is:

1. A toner for developing electrostatic image, comprising a binder resin and a hydrocarbon wax, wherein the hydrocarbon wax provides a DSC curve, as measured by a differential scanning calorimeter, showing an onset temperature of heat absorption in the range of 50°-110° C. and at least one heat absorption peak P1 in the range of 70°-130° C. giving a peak temperature $T_{P1}$ on temperature increase, and showing a maximum heat evolution peak giving a peak temperature in the range of $T_{P1}\pm 9°$ C. on temperature decrease.

2. The toner according to claim 1, wherein said hydrocarbon wax shows an onset temperature of heat absorption of 50°-90° C.

3. The toner according to claim 1, wherein said hydrocarbon wax shows an onset temperature of heat absorption of 60°-90° C.

4. The toner according to claim 1, wherein said hydrocarbon wax provides at least one heat absorption peak P1 in the temperature range of 90°-120° C. on temperature increase.

5. The toner according to claim 1, wherein said hydrocarbon wax shows an onset temperature of 60°-90° C. and provides at least one heat absorption peak in the range of 90°-120° C. on temperature increase.

6. The toner according to claim 1, wherein said hydrocarbon wax has a number-average molecular weight (Mn) of 550-1200.

7. The toner according to claim 1, wherein said hydrocarbon wax has a number-average molecular weight (Mn) of 600-1000.

8. The toner according to claim 1, wherein said hydrocarbon wax has a weight-average molecular weight (Mw) of 800-3600.

9. The toner according to claim 1, wherein said hydrocarbon wax has a weight-average molecular weight (Mw) of 900-3000.

10. The toner according to claim 1, wherein said hydrocarbon wax has a number-average molecular weight (Mn) of 550-1200, and an Mw/Mn ratio of at most 3.

11. The toner according to claim 1, wherein said hydrocarbon wax has a number-average molecular weight (Mn) of 500-1000, and an Mw/Mn ratio of at most 2.5.

12. The toner according to claim 11, wherein said hydrocarbon wax has an Mw/Mn ratio of at most 2.0.

13. The toner according to claim 1, wherein said hydrocarbon wax provides a GPC chromatogram showing a peak in a molecular weight range of 700-2400.

14. The toner according to claim 1, wherein said hydrocarbon wax provides a GPC chromatogram showing a peak in a molecular weight range of 750-2000.

15. The toner according to claim 1, wherein said hydrocarbon wax provides a GPC chromatogram showing a peak in a molecular weight range of 800-1600.

16. The toner according to claim 1, wherein said hydrocarbon wax provides a DSC curve showing a heat absorption peak in the temperature range of 95°-120° C.

17. The toner according to claim 1, wherein said hydrocarbon wax provides a DSC curve showing a heat absorption peak in the temperature range of 97°-115° C.

18. The toner according to claim 1, wherein said hydrocarbon wax provides a maximum heat evolution peak in the temperature range of $T_{P1}\pm 7°$ C. on temperature decrease.

19. The toner according to claim 1, wherein said hydrocarbon wax provides a maximum heat evolution peak in the temperature range of $T_{P1}\pm 5°$ C. on temperature decrease.

20. The toner according to claim 1, wherein said hydrocarbon wax provides a maximum heat evolution peak in the temperature range of 85°-115° C. on temperature decrease.

21. The toner according to claim 1, wherein said hydrocarbon wax provides a maximum heat evolution peak in the temperature range of 90°-110° C. on temperature decrease.

22. The toner according to claim 1, wherein said hydrocarbon wax is contained in an amount of at most 20 wt. parts per 100 wt. parts of the binder resin.

23. The toner according to claim 1, wherein said hydrocarbon wax is contained in an amount of 0.5-10 wt. parts per 100 wt. parts of the binder resin.

24. The toner according to claim 1, wherein said binder resin comprises a styrene copolymer.

25. The toner according to claim 1, wherein said binder resin comprises a polyester resin.

26. The toner according to claim 1, wherein the toner shows a molecular weight distribution on a GPC chromatogram providing at least one peak in a molecular weight region of $3\times 10^3-5\times 10^4$ and at least one peak in a molecular weight region of at least $10^5$ and including at least 50% of a component having a molecular weight of at most $10^5$.

27. The toner according to claim 26, wherein the toner provides a GPC chromatogram showing a peak in the molecular weight region of $3\times 10^3-3\times 10^4$.

28. The toner according to claim 26, wherein the toner provides a GPC chromatogram showing a peak in the molecular weight region of $5\times 10^3-2\times 10^4$.

29. The toner according to claim 26, wherein the toner provides a GPC chromatogram showing a peak in the molecular weight region of $3\times 10^5-2\times 10^6$.

30. The toner according to claim 26, wherein the molecular weight distribution on a GPC chromatogram includes 60-90% of the component having a molecular weight of at most $10^5$.

31. The toner according to claim 26, wherein the molecular weight distribution on a GPC chromatogram includes 65-85% of the component having a molecular weight of at most $10^5$.

32. The toner according to claim 26, wherein the toner shows a molecular weight or a GPC chromatogram such that a maximum peak height H1 in the molecular weight region of $3\times 10^3-5\times 10^4$ a maximum peak height H3 in the molecular weight region of at least $10^5$ and a minimum height H2 between the peaks satisfy the conditions of: H1:H2:H3=3-25:1:1.5-12, and H1>H3.

33. The toner according to claim 32, wherein the heights H1, H2 and H3 satisfy the condition of H1:H2:H3=5-20:1:2-10.

34. The toner according to claim 32, wherein the heights H1, H2 and H3 satisfy the condition of H1:H2:H3=8-18:1:2-6.

35. The toner according to claim 1, wherein said hydrocarbon wax provides a maximum heat absorption peak having a half-value width of at least 10° C.

36. The toner according to claim 1, wherein said hydrocarbon wax provides a maximum heat absorption peak having a half-value width of at least 15° C.

37. The toner according to claim 1, wherein said hydrocarbon wax comprises a wax synthesized from carbon monoxide and hydrogen.

38. A toner for developing electrostatic images, comprising a binder resin and a hydrocarbon wax; wherein the toner provides a DSC curve as measured by a differential scanning calorimeter, showing a rising temperature of heat absorption of at least 80° C., an onset temperature of heat absorption of at most 105° C. and a heat absorption peak temperature in the range of 100°-120° C., respectively on temperature increase, and showing a heat evolution peak giving a heat evolution peak temperature in the range of 62°-75° C. and a heat evolution peak intensity ratio of at least $5\times10^{-3}$ on temperature decrease.

39. The toner according to claim 38, wherein the toner provides a rising temperature of heat absorption of at least 90° C. on temperature increase.

40. The toner according to claim 38, wherein the toner provides a heat evolution peak intensity ratio of at least $10\times10^{-3}$ on temperature decrease.

41. The toner according to claim 38, wherein the toner provides a rising temperature of heat absorption of at least 90° C. on temperature increase, and a heat evolution peak intensity ratio of at least $10\times10^{-3}$ on temperature decrease.

42. The toner according to claim 38, wherein the toner provides a onset temperature of heat absorption in the range of 90°-102° C.

43. The toner according to claim 38, wherein the toner provides a heat absorption peak temperature in the range of 102°-115° C.

44. The toner according to claim 38, wherein the toner provides a heat evolution peak temperature in the range of 65°-72° C.

45. The toner according to claim 38, wherein the toner provides a heat evolution peak intensity ratio of at least $12\times10^{-3}$.

46. The toner according to claim 38, wherein the toner provides a heat evolution peak intensity ratio of at least $15\times10^{-3}$.

47. The toner according to claim 38, wherein said hydrocarbon wax has a number-average molecular weight (Mn) of 550-1200.

48. The toner according to claim 38, wherein said hydrocarbon wax has a number-average molecular weight (Mn) of 600-1000.

49. The toner according to claim 38, wherein said hydrocarbon wax has a weight-average molecular weight (Mw) of 800-3600.

50. The toner according to claim 38, wherein said hydrocarbon wax has a weight-average molecular weight (Mw) of 900-3000.

51. The toner according to claim 38, wherein said hydrocarbon wax has a number-average molecular weight (Mn) of 550-1200, and an Mw/Mn ratio of at most 3.

52. The toner according to claim 38, wherein said hydrocarbon wax has a number-average molecular weight (Mn) of 500-1000, and an Mw/Mn ratio of at most 2.5.

53. The toner according to claim 52, wherein said hydrocarbon wax has an Mw/Mn ratio of at most 2.0.

54. The toner according to claim 38, wherein said hydrocarbon wax provides a GPC chromatogram showing a peak in a molecular weight range of 700-2400.

55. The toner according to claim 38, wherein said hydrocarbon wax provides a GPC chromatogram showing a peak in a molecular weight range of 750-2000.

56. The toner according to claim 38, wherein said hydrocarbon wax provides a GPC chromatogram showing a peak in a molecular weight range of 800-1600.

57. The toner according to claim 38, wherein said hydrocarbon wax shows a melt viscosity of at most 100 cp at 140° C.

58. The toner according to claim 38, wherein said hydrocarbon wax shows a melt viscosity of at most 50 cp at 140° C.

59. The toner according to claim 38, wherein said hydrocarbon wax shows a melt viscosity of at most 20 cp at 140° C.

60. The toner according to claim 38, wherein said hydrocarbon wax is contained in an amount of at most 20 wt. parts per 100 wt. parts of the binder resin.

61. The toner according to claim 38, wherein said hydrocarbon wax is contained in an amount of 0.5-10 wt. parts per 100 wt. parts of the binder resin.

62. The toner according to claim 38, wherein said hydrocarbon wax comprises a wax synthesized from carbon monoxide and hydrogen.

63. The toner according to claim 38, wherein said binder resin comprises a styrene copolymer.

64. The toner according to claim 38, wherein said binder resin comprises a polyester resin.

65. A heat-fixing method, comprising:

heat-fixing a toner image carried by a toner-carrying member onto the toner carrying member by a contact-heating means;

wherein the toner comprises a binder resin and a hydrocarbon wax, and provides a DSC curve, as measured by a differential scanning calorimeter, showing a rising temperature of heat absorption of at least 80° C., an onset temperature of heat absorption of at most 105° C. and a heat absorption peak temperature in the range of 100°-120° C., respectively on temperature increase, and showing a heat evolution peak giving a heat evolution peak temperature in the range of 62°-75° C. and a heat evolution peak intensity ratio of at least $5\times10^{-3}$ on temperature decrease.

66. The method according to claim 65, wherein said contact-heating means comprises heating rollers.

67. The method according to claim 65, wherein said contact-heating means comprises a heating member and a pressing member disposed opposite to the heating member so as to press the toner-carrying member against the heating member with a film disposed between the toner carrying-member and the heating member.

68. The method according to claim 67, wherein said heating member has a heating part at a temperature of 100°-300° C.

69. The method according to claim 67, wherein said film has a heat-resistant layer and a release layer.

70. The method according to claim 67, wherein said film has a heat-resistant layer comprising a polyimide and a release layer comprising a fluorine-containing resin.

71. The method according to claim 67, wherein said pressing member presses the film against the film at a total pressure of 4–20 kg.

72. A heat-fixing method, comprising:

heat-fixing a toner image carried by a toner-carrying member onto the toner carrying member by a contact-heating means;

wherein the toner comprises a binder resin and a hydrocarbon wax; and the hydrocarbon wax provides a DSC curve, as measured by a differential scanning colorimeter, showing an onset temperature of heat absorption in the range of 50°–110° C. and at least one heat absorption peak P1 in the range of 70°–130° C. giving a peak temperature $T_{P1}$ on temperature increase, and showing a maximum heat evolution peak giving a peak temperature in the range of $T_{P1}\pm 9°$ C. on temperature decrease.

73. The method according to claim 72, wherein said contact-heating means comprises heating rollers.

74. The method according to claim 72, wherein said contact-heating means comprises a heating member and a pressing member disposed opposite to the heating member so as to press the toner-carrying member against the heating member with a film disposed between the toner carrying-member and the heating member.

75. The method according to claim 74, wherein said heating member has a heating part at a temperature of 100°–300° C.

76. The method according to claim 74, wherein said film has a heat-resistant layer and a release layer.

77. The method according to claim 74, wherein said film has a heat-resistant layer comprising a polyimide and a release layer comprising a fluorine-containing resin.

78. The method according to claim 74, wherein said pressing member presses the film against the film at a total pressure of 4–20 kg.

* * * * *

UNITED STATES PATENT AND TRADEMARK OFFICE

CERTIFICATE OF CORRECTION

PATENT NO. : 5,364,722

DATED : November 15, 1994

INVENTOR(S) : HIROHIDE TANIKAWA, ET AL.

It is certified that error appears in the above-indentified patent and that said Letters Patent is hereby corrected as shown below:

COLUMN 2

Line 21, "men%her," should read --member,--.
Line 24, "Mount" should read --amount--.
Line 28, "wormed" should read --wound--.
Line 32, "with," should read --with--.
Line 59, "a room" should room--.

COLUMN 3

Line 1, "a room" should read --room--.
Line 8, "-filming" should read --filming--.

COLUMN 4

Line 68, "unnecessitating" should read --eliminating--.

COLUMN 5

Line 6, "an" should read --a--.

COLUMN 6

Line 10, "take" should read --taken--.
Line 30, "mW/mg" should read --Mw/mg--.
Lines 65-68, close up left margin.

COLUMN 7

Lines 1-15, close up left margin.
Line 14, "faction" should read --fraction--.
Line 32, "suitable" should read --being suitable--.

UNITED STATES PATENT AND TRADEMARK OFFICE

CERTIFICATE OF CORRECTION

PATENT NO. : 5,364,722

DATED : November 15, 1994

INVENTOR(S) : HIROHIDE TANIKAWA, ET AL.

It is certified that error appears in the above-indentified patent and that said Letters Patent is hereby corrected as shown below:

COLUMN 8

Line 34, "monodisperse" should read --monodispersed--.
Line 44, "styrus" should read --stylus--.

COLUMN 10

Lines 33-34, "chmarone" should read --cumarone--.

COLUMN 12

Line 12, "As the" should read --The--.

COLUMN 14

Line 1, "case" should read --the case--.
Line 2, "case" should read --the case--.
Line 4, "axed" should read --and--.
Line 24, "pressure" should read --presence--.
Line 31, "polisher" should read --polymer--.
Line 42, "polisher" should read --polymer--.

COLUMN 16

Line 11, "shaked" should read --shaken--.
Line 31, "monodisperse" should read --monodispersed--.
Line 45, "G3000H $H_{XL}$)," should read --G3000H ($H_{XL}$),-- and
"G4000H $H_{XL}$)," should read --G4000H ($H_{XL}$),--.
Line 46, "arid" should read --and--.
Line 58, "acids," should read --acids--.
Line 68, "gous" should read --gues--.

UNITED STATES PATENT AND TRADEMARK OFFICE

CERTIFICATE OF CORRECTION

PATENT NO. : 5,364,722

DATED : November 15, 1994

INVENTOR(S) : HIROHIDE TANIKAWA, ET AL.

It is certified that error appears in the above-indentified patent and that said Letters Patent is hereby corrected as shown below:

COLUMN 18

Line 18, "indanthrene" should read --Indanthrene--.

COLUMN 20

TABLE 1, "On set" should read --Onset--.

COLUMN 22

Line 25, "Go" should read --to--.

COLUMN 23

Line 45, ":good," should read --O:good--.

COLUMN 24

Line 45, "150-the" should read --150th--.

COLUMN 25

Line 44, "Examples" should read --Example--.

COLUMN 27

Line 56, "Polymerization" should read --polymerization--.

COLUMN 31

TABLE 13, "On set" should read --Onset--.

UNITED STATES PATENT AND TRADEMARK OFFICE

CERTIFICATE OF CORRECTION

PATENT NO. : 5,364,722

DATED : November 15, 1994

INVENTOR(S) : HIROHIDE TANIKAWA, ET AL.

It is certified that error appears in the above-indentified patent and that said Letters Patent is hereby corrected as shown below:

COLUMN 35

Line 36, "copolymar" should read --copolymer--.

COLUMN 36

Line 18, "3,5-Di-t-butylsalicylic" should read --3,5-di-t-butylsalicylic--.

COLUMN 37

Line 9, "image," should read --images,--.

COLUMN 38

Line 61, "$5\times10^4$" should read --$5\times10^4$,--.

COLUMN 41

Line 15, "colorimeter," should read --calorimeter,--.

Signed and Sealed this

Fourth Day of April, 1995

*Attest:*

*Attesting Officer*

BRUCE LEHMAN

*Commissioner of Patents and Trademarks*